US007552996B2

(12) United States Patent
Ochiai et al.

(10) Patent No.: US 7,552,996 B2
(45) Date of Patent: Jun. 30, 2009

(54) PRINTING APPARATUS AND PRINTING METHOD

(75) Inventors: Takashi Ochiai, Machida (JP); Hitoshi Tsuboi, Kawasaki (JP); Satoshi Wada, Machida (JP); Yoshitomo Marumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 84 days.

(21) Appl. No.: 11/831,166

(22) Filed: Jul. 31, 2007

(65) Prior Publication Data

US 2008/0049057 A1 Feb. 28, 2008

(30) Foreign Application Priority Data

Aug. 22, 2006 (JP) ..... 2006-225748

(51) Int. Cl.
*B41J 2/155* (2006.01)

(52) U.S. Cl. ..... 347/42; 347/13

(58) Field of Classification Search ..... 347/12, 347/13, 42, 49, 43, 40
See application file for complete search history.

(56) References Cited

U.S. PATENT DOCUMENTS 7,237,871 B2 7/2007 Yamaguchi et al.
7,278,700 B2 10/2007 Yamaguchi et al.
2002/0057309 A1* 5/2002 Ikemoto et al. ..... 347/42
2006/0214957 A1 9/2006 Wada
2006/0274099 A1* 12/2006 Jahana et al. ..... 347/15
2007/0120883 A1 5/2007 Tsuboi
2007/0165056 A1 7/2007 Yamaguchi et al.
2007/0165068 A1 7/2007 Tsuboi
2007/0291062 A1 12/2007 Noguchi et al.
2008/0136855 A1 6/2008 Ochiai et al.
2008/0143767 A1 6/2008 Ochiai et al.

FOREIGN PATENT DOCUMENTS

JP 2002-292859 10/2002

* cited by examiner

*Primary Examiner*—Lamson D Nguyen
(74) *Attorney, Agent, or Firm*—Fitzpatrick, Cella, Harper & Scinto

(57) ABSTRACT

In a printing apparatus and method, both high-speed and high-quality formation of images can be achieved. The apparatus has a full-line printhead that includes printhead chips. A plurality of printing element arrays are disposed in parallel on the same printhead chip, and a distribution ratio of print data is controlled so as to at least differ in an overlap area in which end portions of the printing element arrays overlap each other.

6 Claims, 22 Drawing Sheets

FIG. 7

| | | PRINTHEAD CHIP | | | | | | | | | | | |
|---|---|---|---|---|---|---|---|---|---|---|---|---|---|
| | | 41 | | 42 | | 43 | | 44 | | 45 | | 46 | |
| | | 41A | 41B | 42A | 42B | 43A | 43B | 44A | 44B | 45A | 45B | 46A | 46B |
| PRINTING POSITION | SECTION 41 (NON-JOINT) | 0.5 | 0.5 | - | - | - | - | - | - | - | - | - | - |
| | SECTION 41-42 (JOINT) | 0.0 | 0.5 | 0.5 | 0.0 | - | - | - | - | - | - | - | - |
| | SECTION 42 (NON-JOINT) | - | - | 0.5 | 0.5 | - | - | - | - | - | - | - | - |
| | SECTION 42-43 (JOINT) | - | - | 0.0 | 0.5 | 0.5 | 0.0 | - | - | - | - | - | - |
| | SECTION 43 (NON-JOINT) | - | - | - | - | 0.5 | 0.5 | - | - | - | - | - | - |
| | SECTION 43-44 (JOINT) | - | - | - | - | 0.0 | 0.5 | 0.5 | 0.0 | - | - | - | - |
| | SECTION 44 (NON-JOINT) | - | - | - | - | - | - | 0.5 | 0.5 | - | - | - | - |
| | SECTION 44-45 (JOINT) | - | - | - | - | - | - | 0.0 | 0.5 | 0.5 | 0.0 | - | - |
| | SECTION 45 (NON-JOINT) | - | - | - | - | - | - | - | - | 0.5 | 0.5 | - | - |
| | SECTION 45-46 (JOINT) | - | - | - | - | - | - | - | - | 0.0 | 0.5 | 0.5 | 0.0 |
| | SECTION 46 (NON-JOINT) | - | - | - | - | - | - | - | - | - | - | 0.5 | 0.5 |

FIG. 9

| | | PRINTHEAD CHIP | | | | | | | | | | | |
|---|---|---|---|---|---|---|---|---|---|---|---|---|---|
| | | 41 | | 42 | | 43 | | 44 | | 45 | | 46 | |
| | | 41A | 41B | 42A | 42B | 43A | 43B | 44A | 44B | 45A | 45B | 46A | 46B |
| PRINTING POSITION | SECTION 41 (NON-JOINT) | 0.5 | 0.5 | - | - | - | - | - | - | - | - | - | - |
| | SECTION 41-42 (JOINT) | 0.25 | 0.25 | 0.25 | 0.25 | - | - | - | - | - | - | - | - |
| | SECTION 42 (NON-JOINT) | - | - | 0.5 | 0.5 | - | - | - | - | - | - | - | - |
| | SECTION 42-43 (JOINT) | - | - | 0.25 | 0.25 | 0.25 | 0.25 | - | - | - | - | - | - |
| | SECTION 43 (NON-JOINT) | - | - | - | - | 0.5 | 0.5 | - | - | - | - | - | - |
| | SECTION 43-44 (JOINT) | - | - | - | - | 0.25 | 0.25 | 0.25 | 0.25 | - | - | - | - |
| | SECTION 44 (NON-JOINT) | - | - | - | - | - | - | 0.5 | 0.5 | - | - | - | - |
| | SECTION 44-45 (JOINT) | - | - | - | - | - | - | 0.25 | 0.25 | 0.25 | 0.25 | - | - |
| | SECTION 45 (NON-JOINT) | - | - | - | - | - | - | - | - | 0.5 | 0.5 | - | - |
| | SECTION 45-46 (JOINT) | - | - | - | - | - | - | - | - | 0.25 | 0.25 | 0.25 | 0.25 |
| | SECTION 46 (NON-JOINT) | - | - | - | - | - | - | - | - | - | - | 0.5 | 0.5 |

FIG. 13

| | | PRINTHEAD CHIP | | | | | |
|---|---|---|---|---|---|---|---|
| | | 51 | 52 | 53 | 54 | 55 | 56 |
| PRINTING POSITION | SECTION 51 (NON-JOINT) | 1.0 | - | - | - | - | - |
| | SECTION 51-52 (JOINT) | 0.5 | 0.5 | - | - | - | - |
| | SECTION 52 (NON-JOINT) | - | 1.0 | - | - | - | - |
| | SECTION 52-53 (JOINT) | - | 0.5 | 0.5 | - | - | - |
| | SECTION 53 (NON-JOINT) | - | - | 1.0 | - | - | - |
| | SECTION 53-54 (JOINT) | - | - | 0.5 | 0.5 | - | - |
| | SECTION 54 (NON-JOINT) | - | - | - | 1.0 | - | - |
| | SECTION 54-55 (JOINT) | - | - | - | 0.5 | 0.5 | - |
| | SECTION 55 (NON-JOINT) | - | - | - | - | 1.0 | - |
| | SECTION 55-56 (JOINT) | - | - | - | - | 0.5 | 0.5 |
| | SECTION 56 (NON-JOINT) | - | - | - | - | - | 1.0 |

FIG. 17

| PRINTING POSITION | PRINTHEAD CHIP | | | | | | | | | | | | | | | | | | | | | | | |
|---|---|---|---|---|---|---|---|---|---|---|---|---|---|---|---|---|---|---|---|---|---|---|---|---|
| | 61 | | | | 62 | | | | 63 | | | | 64 | | | | 65 | | | | 66 | | | |
| | 61A | 61B | 61C | 61D | 62A | 62B | 62C | 62D | 63A | 63B | 63C | 63D | 64A | 64B | 64C | 64D | 65A | 65B | 65C | 65D | 66A | 66B | 66C | 66D |
| SECTION 61 (NON-JOINT) | 0.25 | 0.25 | 0.25 | 0.25 | - | - | - | - | - | - | - | - | - | - | - | - | - | - | - | - | - | - | - | - |
| SECTION 61-62 (JOINT) | 0.0 | 0.0 | 0.25 | 0.25 | 0.25 | 0.25 | 0.0 | 0.0 | - | - | - | - | - | - | - | - | - | - | - | - | - | - | - | - |
| SECTION 62 (NON-JOINT) | - | - | - | - | 0.25 | 0.25 | 0.25 | 0.25 | - | - | - | - | - | - | - | - | - | - | - | - | - | - | - | - |
| SECTION 62-63 (JOINT) | - | - | - | - | 0.0 | 0.0 | 0.25 | 0.25 | 0.25 | 0.25 | 0.0 | 0.0 | - | - | - | - | - | - | - | - | - | - | - | - |
| SECTION 63 (NON-JOINT) | - | - | - | - | - | - | - | - | 0.25 | 0.25 | 0.25 | 0.25 | - | - | - | - | - | - | - | - | - | - | - | - |
| SECTION 63-64 (JOINT) | - | - | - | - | - | - | - | - | 0.0 | 0.0 | 0.25 | 0.25 | 0.25 | 0.25 | 0.0 | 0.0 | - | - | - | - | - | - | - | - |
| SECTION 64 (NON-JOINT) | - | - | - | - | - | - | - | - | - | - | - | - | 0.25 | 0.25 | 0.25 | 0.25 | - | - | - | - | - | - | - | - |
| SECTION 64-65 (JOINT) | - | - | - | - | - | - | - | - | - | - | - | - | 0.0 | 0.0 | 0.25 | 0.25 | 0.25 | 0.25 | 0.0 | 0.0 | - | - | - | - |
| SECTION 65 (NON-JOINT) | - | - | - | - | - | - | - | - | - | - | - | - | - | - | - | - | 0.25 | 0.25 | 0.25 | 0.25 | - | - | - | - |
| SECTION 65-66 (JOINT) | - | - | - | - | - | - | - | - | - | - | - | - | - | - | - | - | 0.0 | 0.0 | 0.25 | 0.25 | 0.25 | 0.25 | 0.0 | 0.0 |
| SECTION 66 (NON-JOINT) | - | - | - | - | - | - | - | - | - | - | - | - | - | - | - | - | - | - | - | - | 0.25 | 0.25 | 0.25 | 0.25 |

FIG. 19

| PRINTING POSITION | PRINTHEAD CHIP | | | | | | | | | | | | | | | | | | | | | | | |
|---|---|---|---|---|---|---|---|---|---|---|---|---|---|---|---|---|---|---|---|---|---|---|---|---|
| | 61 | | | | 62 | | | | 63 | | | | 64 | | | | 65 | | | | 66 | | | |
| | 61A | 61B | 61C | 61D | 62A | 62B | 62C | 62D | 63A | 63B | 63C | 63D | 64A | 64B | 64C | 64D | 65A | 65B | 65C | 65D | 66A | 66B | 66C | 66D |
| SECTION 61 (NON-JOINT) | 0.25 | 0.25 | 0.25 | 0.25 | - | - | - | - | - | - | - | - | - | - | - | - | - | - | - | - | - | - | - | - |
| SECTION 61-62 (JOINT) | 0.125 | 0.125 | 0.125 | 0.125 | 0.125 | 0.125 | 0.125 | 0.125 | - | - | - | - | - | - | - | - | - | - | - | - | - | - | - | - |
| SECTION 62 (NON-JOINT) | - | - | - | - | 0.25 | 0.25 | 0.25 | 0.25 | - | - | - | - | - | - | - | - | - | - | - | - | - | - | - | - |
| SECTION 62-63 (JOINT) | - | - | - | - | 0.125 | 0.125 | 0.125 | 0.125 | 0.125 | 0.125 | 0.125 | 0.125 | - | - | - | - | - | - | - | - | - | - | - | - |
| SECTION 63 (NON-JOINT) | - | - | - | - | - | - | - | - | 0.25 | 0.25 | 0.25 | 0.25 | - | - | - | - | - | - | - | - | - | - | - | - |
| SECTION 63-64 (JOINT) | - | - | - | - | - | - | - | - | 0.125 | 0.125 | 0.125 | 0.125 | 0.125 | 0.125 | 0.125 | 0.125 | - | - | - | - | - | - | - | - |
| SECTION 64 (NON-JOINT) | - | - | - | - | - | - | - | - | - | - | - | - | 0.25 | 0.25 | 0.25 | 0.25 | - | - | - | - | - | - | - | - |
| SECTION 64-65 (JOINT) | - | - | - | - | - | - | - | - | - | - | - | - | 0.125 | 0.125 | 0.125 | 0.125 | 0.125 | 0.125 | 0.125 | 0.125 | - | - | - | - |
| SECTION 65 (NON-JOINT) | - | - | - | - | - | - | - | - | - | - | - | - | - | - | - | - | 0.25 | 0.25 | 0.25 | 0.25 | - | - | - | - |
| SECTION 65-66 (JOINT) | - | - | - | - | - | - | - | - | - | - | - | - | - | - | - | - | 0.125 | 0.125 | 0.125 | 0.125 | 0.125 | 0.125 | 0.125 | 0.125 |
| SECTION 66 (NON-JOINT) | - | - | - | - | - | - | - | - | - | - | - | - | - | - | - | - | - | - | - | - | 0.25 | 0.25 | 0.25 | 0.25 |

PRINTING APPARATUS AND PRINTING METHOD

BACKGROUND OF THE INVENTION

1. Field of the Invention

The present invention relates to a printing apparatus and method for performing printing using a printhead having a plurality of printing elements arrayed in rows. More particularly, the invention relates to a printing apparatus and method ideal in a case where use is made of a so-called full-line-type ink-jet printhead.

2. Description of the Related Art

A printing apparatus used as a printer or copier, etc., or as the output device of a multifunction electronic device or work station inclusive of a computer or word processor, etc., is adapted to print an image (inclusive of characters and symbols) on a printing medium such as printing paper based upon print information. Such printing apparatuses are classified into those that rely upon ink-jet, wire-dot, thermal and laser printing schemes.

In a so-called serial-type printing apparatus that prints while scanning in a main-scan direction that intersects the conveyance direction (sub-scan direction) of a printing medium, an image is printed using a printhead serving as printing means moved along the printing medium. That is, printing is performed over the entire area of the printing medium by repeating an operation of conveying the printing medium a prescribed amount at a time whenever one main scan of printing is completed by the printhead.

In a so-called full-line-type printing apparatus in which the printhead has a printing width that corresponds to the width of the printing medium so that the only motion is in the conveyance direction of the printing medium, the printing medium is placed at a prescribed position and printing is performed one line at a time while the printing medium is conveyed. Printing over the entire area of the printing medium is thus performed.

Among these types of printing apparatuses, the ink-jet printing apparatus, which uses an ink-jet printhead as printing means and performs printing by discharging ink toward the printing medium from discharge orifices of the printhead, is advantageous in that it lends itself to size reduction of the printhead, is capable of forming a high-definition image at high speed and features low running cost since it is capable of printing on so-called plain paper without requiring special processing. Additional advantages are low noise owing to non-impact printing and the ability to form a color image using inks of multiple colors. Furthermore, these types of printing apparatus include a full-line printing apparatus that uses a so-called full-line-type printhead in which a number of ink-jet printing elements are arrayed to intersect (generally at a right angle) the conveyance direction of the printing medium. The full-line printing apparatus is capable of forming images at much higher speeds and has become noteworthy owing to the possibility of use as an on-demand printing apparatus for which there is increasing need at present. (By way of example, see the specification of Japanese Patent Application Laid-Open No. 2002-292859). The ink-jet printing elements are situated along the full width of the printing area of the printing medium and are capable of discharging ink from discharge orifices.

In a full-line printing apparatus for such on-demand printing, monochrome printing such as the printing of text requires printing on a printing medium of size A3 at a rate of 30 pages per minute or greater with a resolution of 600×600 dpi (dots per inch) or greater.

Further, printing of a full-color image such as a photograph requires printing on a printing medium of size A3 at a rate of 30 pages per minute or greater with a resolution of 1200×1200 or greater.

However, in the case of a printhead used in the above-described full-line printing apparatus, it is difficult to machine, without defects, all of the ink-jet printing elements situated across the full width of the printing area of the printing medium. It is particularly difficult to machine, without defects, all of the discharge orifices that constitute part of the ink-jet printing elements. For example, in order to print on size A3 paper with a resolution of 1200 dpi in a full-line printing apparatus, it is necessary to form about 14,000 discharge orifices in the full-line printhead (across a printing width of about 280 mm). Further, in terms of the manufacturing process of a full-line printhead, it is difficult to machine all of the ink-jet printing elements corresponding to this multiplicity of discharge orifices without a single defect. In addition, even if such a printhead could be manufactured, the success rate would be low and manufacturing cost high.

For these reasons, a so-called connecting head has been proposed as a full-line printhead used in a full-line ink-jet printing apparatus. The connecting head includes a plurality of printhead chips each having a printing element array in each of which a plurality of printing elements have been arrayed. The plurality of printhead chips are arrayed in the direction of the printing element arrays. In the connecting head, a plurality of comparatively inexpensive short chips of the kind used in the printhead of the serial-type printing apparatus are joined together in the direction in which the discharge orifices are arrayed. An increase in length of the printhead is achieved by arraying these chips with high precision.

However, as a result of research, the inventors have clarified that because of the structure of the connecting head, a decline in image quality, namely the appearance of a so-called "connecting line", tends to occur at printed portions printed by the printing elements situated at the joints between the plurality of chips. The joints are at locations where there is overlap between the end portions of the printing element arrays of mutually adjacent printhead chips. More specifically, conveyance of the printing medium in the printing apparatus tends to vary (this is so-called "conveyance meandering"), and a tilt develops in the relative positional relationship between the full-line printhead and printing medium. Because of these effects, the discharge orifice pitch formed by the discharge orifices of the mutually adjacent printing elements at the joint is not the same as that of the other discharge orifices, and a line (the above-mentioned connecting line) corresponding to the joint between the chips appears. Owing to the structure of the connecting head, there are many cases where the distance between the rows of discharge orifices in the direction of these rows used in printing at the joints is greater than that of the rows of discharge orifices used in printing at the portions where joints are absent. As a consequence, it is believed that a contributing factor to the decline in image quality is that printing is readily susceptible to the effects of conveyance meandering or inclination at the joints.

The above-mentioned Japanese Patent Application Laid-Open No. 2002-292859 has also been disclosed as means for dealing with connecting lines produced by the connecting head, and several improvements have been proposed thus far. For example, there is a method of reducing a difference in the pitch of the discharge orifices using an arraying method or arraying apparatus for arraying the chips at the joints in a highly accurate manner. Another method for dealing with the problem is to array a prescribed number each of discharge orifices at the ends of the chips so as to overlap in the conveyance direction of the printing medium at the joints between chips without arraying the discharge orifices at the ends of the chips such that they will be adjacent in the array direction of the orifices. In this case, connecting lines are rendered inconspicuous by discharging ink from both of the mutually overlapping discharge orifices at the time of printing.

Nevertheless, these measures are not fully satisfactory for dealing with connecting lines that occur when performing photograph-like printing.

As a result of research, the inventors have discovered that there are cases where connecting lines are reduced by adopting multiple printing element arrays on the printhead chip of a full-line printhead. In most cases, however, good results are not obtained merely by adopting multiple printing element arrays. Accordingly, by conducting further extensive research with regard to how to adopt multiple printing element arrays on printhead chips in order to reduce connecting lines, the inventors have completed the present invention.

SUMMARY OF THE INVENTION

The present invention is directed toward a printing apparatus and printing method.

The printing apparatus and printing method according to this invention are capable of achieving a printed image of high-quality without the appearance of connecting lines while maintaining the high speed of image formation that is an advantage of a full-line ink-jet printing apparatus.

According to one aspect of the present invention, there is provided a printing apparatus having a printhead constituted by a plurality of printhead chips on each of which are arranged in parallel a plurality of printing element arrays in each of which a plurality of printing elements are arrayed, the plurality of printhead chips being arrayed in one direction in such a manner that end portions of the printing element arrays overlap each other, the printing apparatus using the printhead to print an image on a printing medium by conveying the printing medium in a direction that intersects the one direction, the apparatus comprising:

an input unit configured to input print data;

a distributing unit configured to distribute the print data to be used in printing to the printing element arrays, the print data being distributed per printing element array; and a control unit configured to control a distribution ratio of print data, which is distributed by the distributing unit, in such a manner that the distribution ratio will at least be different in an overlap area where the end portions of the printing element arrays on the same printhead chip overlap each other.

According to another aspect of the present invention, there is provided a printing method using a printing apparatus having a printhead constituted by a plurality of printhead chips on each of which are arranged in parallel a plurality of printing element arrays in each of which a plurality of printing elements are arrayed, the plurality of printhead chips being arrayed in one direction in such a manner that end portions of the printing element arrays overlap each other, the printing apparatus using the printhead to print an image on a printing medium by conveying the printing medium in a direction that intersects the one direction, the method comprising:

an input step of inputting print data;

a distributing step of distributing the print data to be used in printing to the printing element arrays, the print data being distributed per printing element array; and a control step of controlling a distribution ratio of print data, which is distributed at the distributing step, in such a manner that the distribution ratio will at least be different in an overlap area where the end portions of the printing element arrays on the same printhead chip overlap each other.

The invention is particularly advantageous since a high-quality image can be printed at high speed using particularly a full-line printhead in which a plurality of printing elements are provided in a row and a plurality of the rows of plural printing elements are arrayed in the row direction.

Further features of the present invention will become apparent from the following description of exemplary embodiments with reference to the attached drawings.

BRIEF DESCRIPTION OF THE DRAWINGS

FIG. 7, which illustrates the first embodiment of the present invention, is an explanatory view showing each printing element array in FIG. 5 and the printing ratios of these in the conveyance direction of a printing medium;

FIG. 9, which is illustrated as a first referential example for comparison with the first embodiment of the invention, shows each printing element array in FIG. 5 and the printing ratios of these in the conveyance direction of a printing medium;

FIG. 13, which illustrates a first comparative example, is an explanatory view showing each printing element array in FIG. 11 and the printing ratios of these in the conveyance direction of a printing medium;

FIG. 17, which illustrates the second embodiment of the present invention, is an explanatory view showing each printing element array in FIG. 15 and the printing ratios of these in the conveyance direction of a printing medium;

FIG. 19, which is illustrated as a second referential example for comparison with the second embodiment of the invention, shows each printhead chip in FIG. 15 and the printing ratios of these in the conveyance direction of a printing medium;

DESCRIPTION OF THE EMBODIMENTS

Embodiments of the present invention will now be described with reference to the drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

<Basic Structure of Printing Apparatus (FIGS. 1 and 2)>

Figure 1:
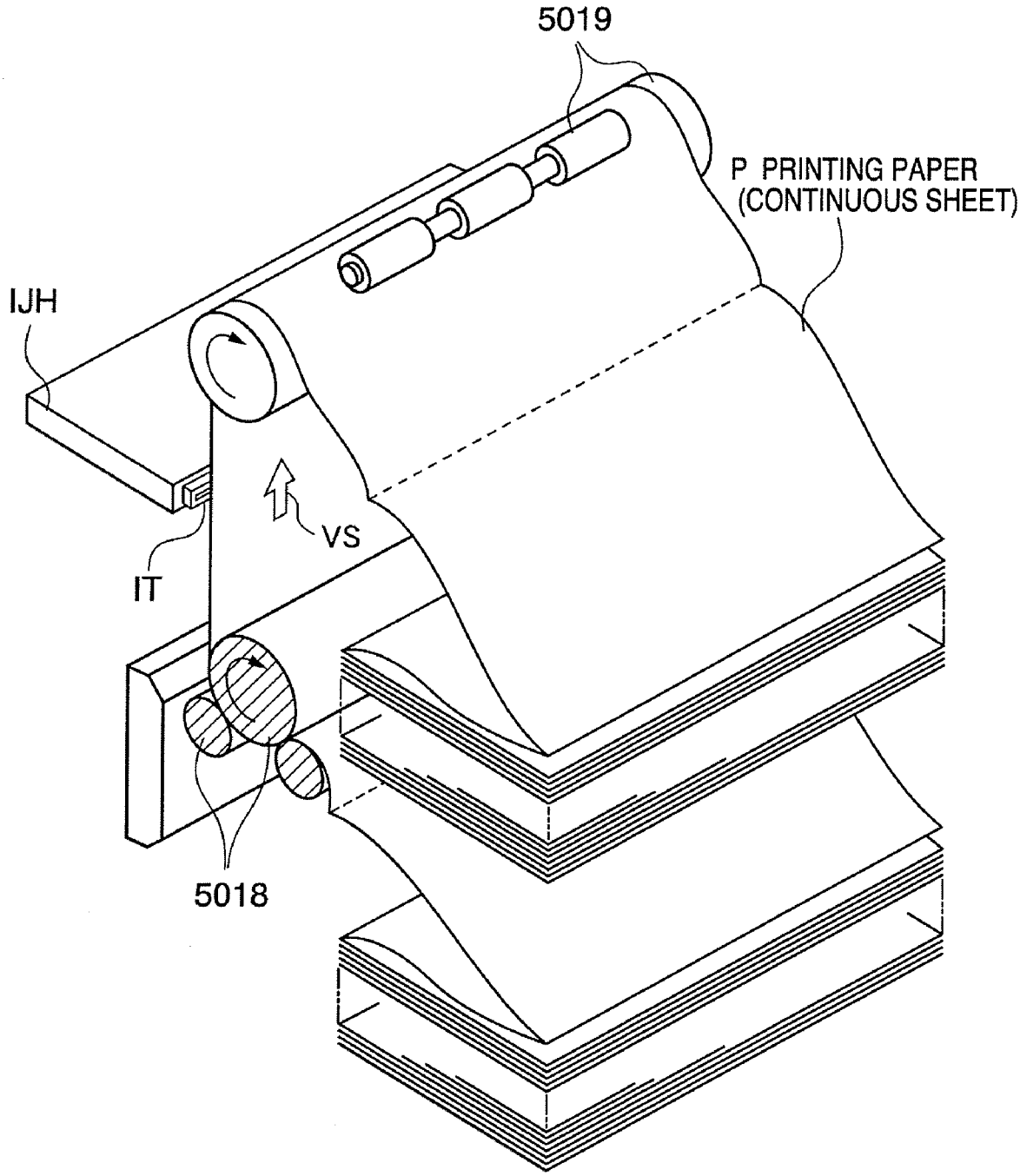
FIG. 1 is an external perspective view useful in describing the conceptual configuration of an ink-jet printing apparatus according to an embodiment of the present invention.

FIG. 1 is an external perspective view illustrating the configuration of the major constituents of an ink-jet printer IJRA according to a preferred embodiment of the present invention. As illustrated in FIG. 1, the ink-jet printer of this embodiment has a printhead (full-line printhead) IJH for discharging ink over the full width of a printing medium P such as printing paper in the form of a continuous sheet, by way of example. Ink is discharged from discharge orifices of a printhead chip IT of the printhead IJH toward the printing medium P at a prescribed timing.

In this embodiment, a conveyance motor is driven under the control of a control circuit (described below), thereby conveying the printing paper (printing medium P) in the VS direction, shown in FIG. 1, so that an image is printed on the printing paper. The printing paper is a continuous sheet capable of being folded upon itself. The printing paper is conveyed by conveyance rollers 5018. Discharge-side rollers 5019 hold the printing medium P at the printing position together with the conveyance rollers 5018 and convey the printing medium P in the direction of arrow VS in operative association with the conveyance rollers 5018 driven by a driving motor (not shown).

FIG. 1 illustrates an arrangement for performing monochrome printing. Specifically, the arrangement is equipped with the single full-line printhead IJH in order to discharge black (K) ink. In a case where color printing is performed, however, at least four full-line printheads are provided along the conveyance direction of the printing medium in accordance with the inks used in color printing, as will be described later with reference to FIG. 2. For example, the inks used are yellow (Y) ink, magenta (M) ink, cyan (C) ink and black (K) ink.

In order to achieve high-quality printing or high-speed printing, two full-line printheads that discharge ink of the same color may be provided, by way of example.

The printing medium used in the printing apparatus may be a continuous sheet, as illustrated, or cut sheets.

Figure 2:
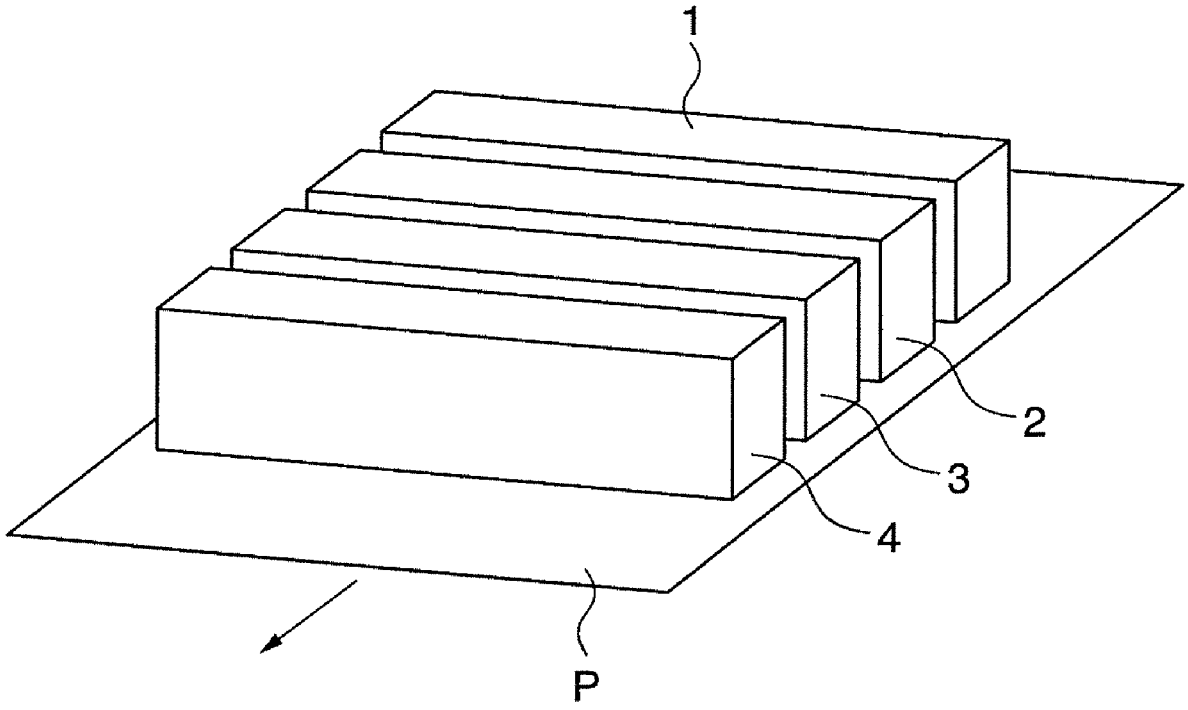
FIG. 2 is a front view useful in describing the conceptual configuration of another ink-jet printing apparatus according to an embodiment of the present invention.

FIG. 2 is a front view useful in describing the conceptual configuration of another ink-jet printing apparatus according to an embodiment of the present invention, this diagram being centered on the printheads. A head unit is constituted by a plurality of long-length ink-jet printheads 1, 2, 3, 4. A plurality of ink-jet printing elements that discharge ink from corresponding ink discharge orifices are arrayed on each of the ink-jet printheads 1, 2, 3, 4. The printheads 1, 2, 3, 4 are long-length printheads for discharging inks of the colors black (K), cyan (C), magenta (M) and yellow (Y), respectively. An ink supply tube (not shown) is connected to each printhead, and a control signal, etc., is sent to each printhead via a flexible cable, not shown. The printing medium P, such as plain paper, high-resolution paper, an OHP sheet, glossy paper, glossy film or postcard is held between conveyance rollers or discharge rollers (not shown) and is fed in the direction of the arrow with driving of a conveyance motor. The ink-jet printing elements include the discharge orifices and energy generating elements, which are provided in correspondence with respective ones of the orifices, for generating ink-discharge energy. Each ink-jet printing element in this example has a heater (an electrothermal transducer), which is provided in a fluid channel communicating with the ink discharge orifice, for generating thermal energy utilized in ink discharge. By driving the heater based upon a print signal in conformity with the read timing of a linear encoder (not shown) that detects the conveyance position of the printing medium P, ink droplets are discharged from the ink discharge orifice and attach themselves to the printing medium P. An image can be formed by the ink droplets that have impacted upon the printing medium P.

When the ink-jet printhead is not performing printing, the face of the ink discharge orifice is sealed by a cap of capping means (not shown), thereby preventing clogging due to solidification of the ink, which is caused by evaporation of the ink solvent, or attachment of a foreign substance such as dust.

Further, the cap portion of the capping means can be utilized to perform a preliminary discharge for preventing discharge failure or clogging of a little used ink discharge orifice, i.e., in order to discharge ink, which does not participate in printing of an image, from the discharge orifice toward the cap. Further, by bringing the interior of the cap portion in the capped state to negative pressure using a pump (not shown), sucking ink that does not participate in printing of an image from the ink discharge orifice of the printhead and discharging the ink into the cap portion, an ink discharge orifice that failed to discharge ink properly can be made to recover. Further, by placing a blade (a wiping member) (not shown) at a position adjacent to the cap portion, it is possible to clean (wipe off) the forming surface of the ink discharge orifice in the ink-jet head.

<Basic Structure of Printhead (FIG. 3)>

Figure 3:
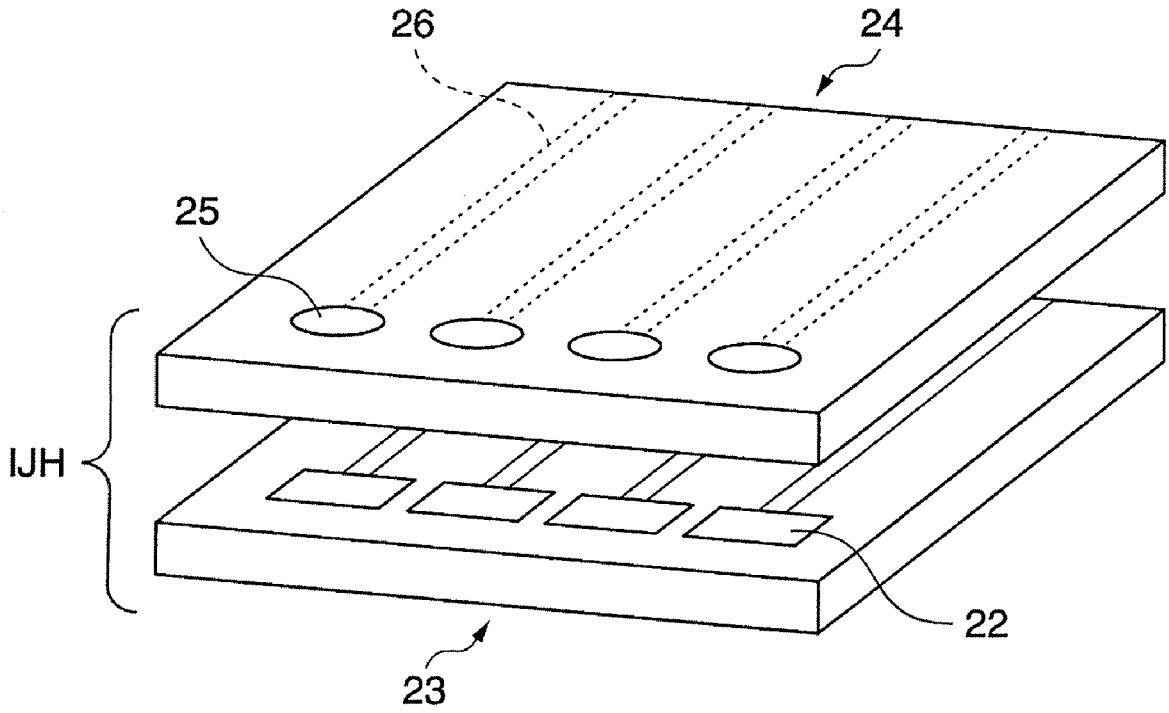
FIG. 3 is an exploded perspective view illustrating an example of the arrangement of the principal parts of an ink-jet printhead.

FIG. 3 is an exploded perspective view illustrating an example of the arrangement of the main constituents of the above-mentioned ink-jet printhead.

The ink-jet printhead IJH of this example mainly comprises a heater board 23, which is a substrate on which a plurality of heaters (heating elements) 22 for heating ink have been formed, and a top plate 24 that is placed on the heater board 23. The top plate 24 is formed to have a plurality of discharge orifices 25. Formed in the top plate 24 rearwardly of the discharge orifices 25 are tunnel-like fluid channels 26 communicating with the respective discharge orifices 25. The channels 26 are connected in common with a single ink chamber located at the rear. Ink is supplied to the ink chamber via an ink supply port, and the ink is supplied to each channel 26 from the ink chamber. The discharge orifices 25 form ports that are capable of discharging the ink.

The heater board 23 and top plate 24 are assembled in such a manner that the heaters 22 are situated at the positions corresponding to the channels 26, as illustrated in FIG. 3. In FIG. 3, four each of the discharge orifices 25, heaters 22 and channels 26 are illustrated as a representative example, and one heater 22 is provided in correspondence with each channel 26. By supplying a prescribed driving pulse to each heater 22 in the ink-jet printhead IJH assembled as shown in FIG. 3, the ink over the heater 22 is caused to boil and form an air bubble. Owing to the volumetric expansion of the air bubble, the ink is discharged by being force out of the discharge orifice 25.

It should be noted that the ink-jet printing scheme to which the invention is applicable is not limited to the bubble-jet scheme using heating elements (heaters) of the kind shown in FIGS. 2 and 3. For example, the present invention is applicable also to an ink-jet scheme that discharges ink utilizing mechanical pressure produced by a piezoelectric element.

<Control Configuration of Printing Apparatus (FIG. 4)>

Figure 4:
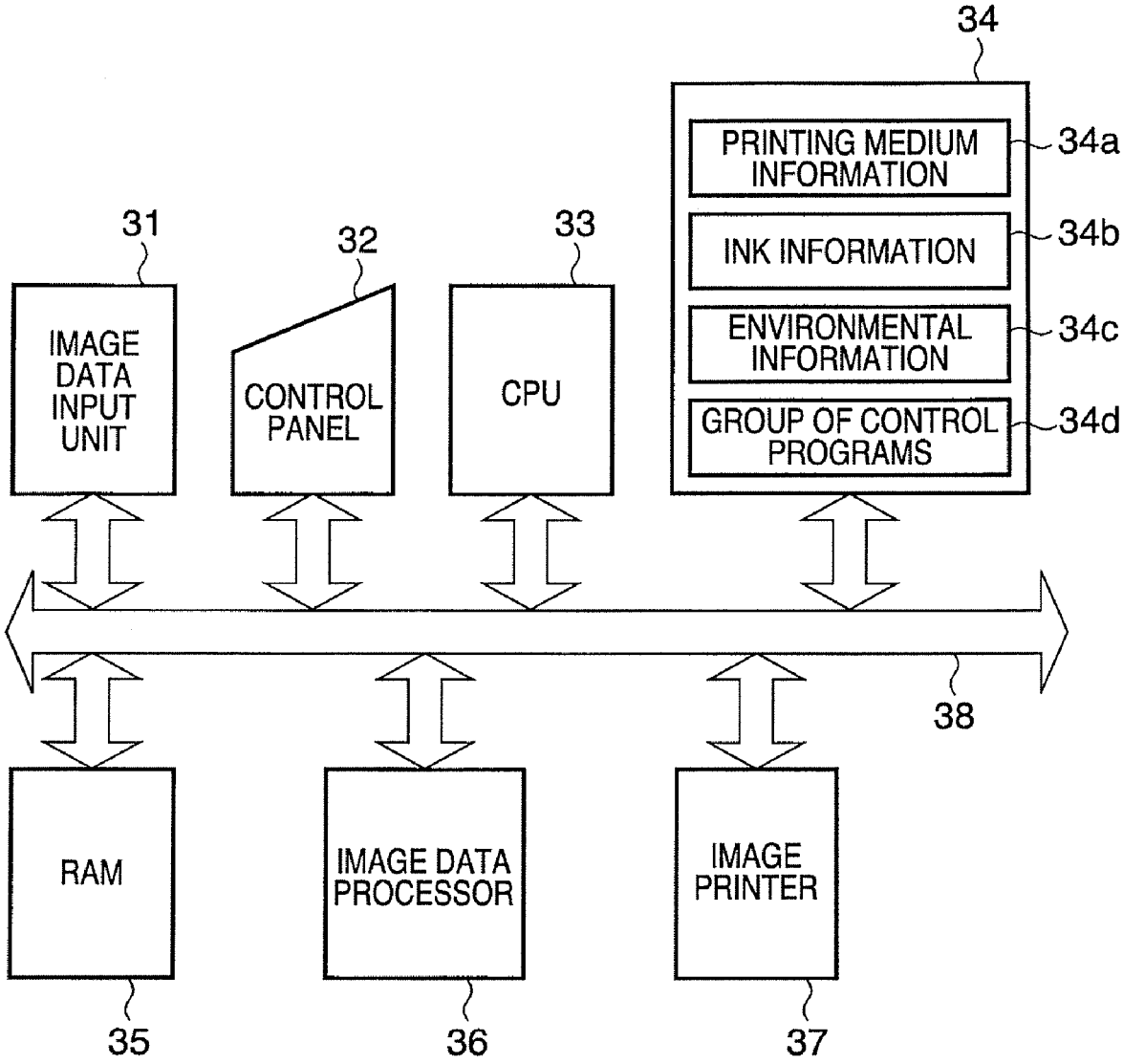
FIG. 4 is a block diagram illustrating an example of the configuration of a control system in an ink-jet printing apparatus as an embodiment of the present invention.

FIG. 4 is a block diagram illustrating an example of the configuration of a control system in an ink-jet printing apparatus according to the present invention.

As shown in FIG. 4, the system includes an image data input unit 31, a control panel 32, a CPU 33 for executing various processing and a storage medium 34 for storing various data. The storage medium 34 has a printing-information storage memory. The information stored here is information 34*a* relating mainly to the type of printing medium, information 34*b* relating to the ink used in printing, and information 34*c* relating to the environment, such as the temperature and humidity at the time of printing. A group 34*d* of various control programs 34 also is stored. The system further includes a RAM 35, an image data processor 36, an image printer 37 for outputting an image and a bus 38 for transferring various data.

More specifically, the image data input unit 31 inputs multi-valued image data from an image input device such as a scanner or digital camera, or multi-valued image data that has been stored on a hard disk of a personal computer, etc. The control panel 32 has various keys for setting various parameters and instructing the start of printing. The CPU 33 controls the overall printing apparatus in accordance with various programs on the storage medium. A program for operating the printing apparatus in accordance with control programs or error processing programs has been stored on the storage medium 34. Operations in this example are all executed in accordance with this program. A ROM, flexible disk, CD-ROM, hard disk, memory card or magneto-optical drive, etc., can be used as the storage medium 34 for storing such a program. The RAM 35 is used as a work area of various programs on the storage medium 34, a temporary save area for when error processing is executed, and a work area when image processing is executed. Further, after various tables on the storage medium 34 have been copied to the RAM 35, the content of these tables can be changed and image processing can proceed while reference is had to the changed tables.

The image data processor 36 quantizes the entered multi-valued image data to N-valued image data pixel by pixel and creates an ink discharge pattern corresponding to a tone value "K" indicated by each pixel quantized. That is, after quantizing the entered multi-valued image data to N-valued image data, the image data processor 36 creates a discharge pattern corresponding to the tone value "K". For example, in a case where multi-valued image date expressed by eight bits (256 tones) has been input to the image data input unit 31, it is necessary that the image data processor 36 convert the tone value of the output image data to a value of 25 (=24+1). In this example, use is made of the multi-valued error diffusion method when an ink discharge pattern corresponding to the tone value "K" is created from the entered multi-valued image data. However, this does not impose a limitation. For example, any halftoning method, such as the mean-density preservation method or dither matrix method, can be used. Further, creation of the discharge pattern corresponding to the tone value "K" is repeated a number of times equivalent to the total number of pixels based upon density information of the image, thereby forming a binary driving signal indicative of discharge or non-discharge of ink pixel by pixel corresponding to the respective discharge orifice 25.

The CPU 33 distributes the print data in order that the discharge pattern created by the image data processor 36 will be printed in the image printer 37. Accordingly, the CPU 33 exercises control in such a manner that the distribution ratio of the print data will at least be different in an overlap area where the end portions of the printing element arrays on the same printhead chip overlap each other.

Based upon the ink discharge pattern that has been created by the image data processor 36, the image printer 37 discharges ink from the corresponding discharge orifices 25 and forms dot images on the printing medium. The bus line 38 transmits address signals, data and control signals, etc., within the apparatus.

Specific embodiments of the present invention used in the printing apparatus constructed as set forth above will now be described based upon the arrangement and driving of the discharge orifices, which constitute a characterizing feature of the invention, and an actual printing operation that uses printheads. It should be noted that this example is one example only, and it goes without saying that the invention is not limited to this example.

First, print data can be created by a technique used in an ordinary ink-jet printer. In these embodiments, it is assumed that an input image has been separated into colors in such a manner that the colors will correspond to the printheads of the respective ink colors, and that the color-separated gray-level images have been binarized by the error diffusion method to thereby prepare print data to be printed by the printheads of the respective ink colors.

First Embodiment

Figure 5:
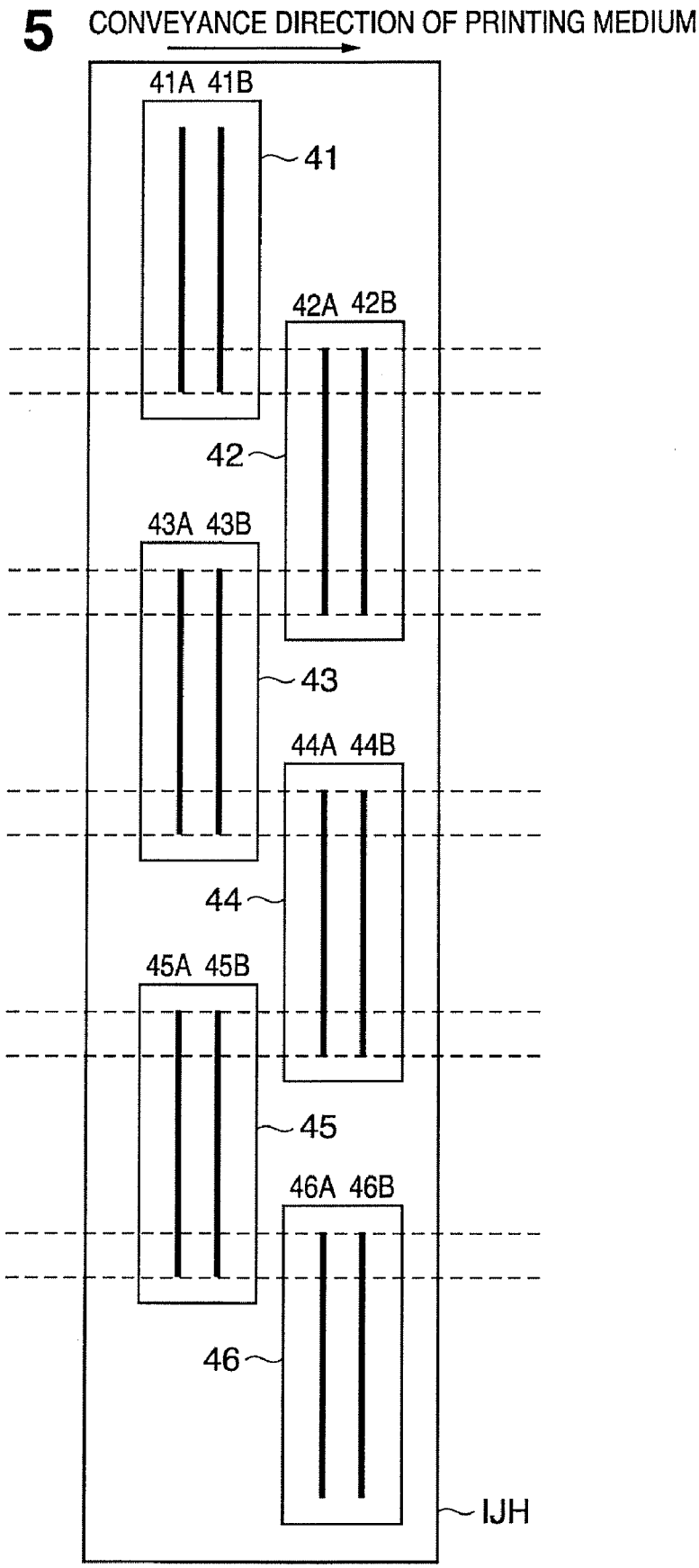
FIG. 5 is a schematic view illustrating the arrangement of a plurality of printing element arrays of a full-line-type long-length printhead as a first embodiment to which the present invention is applicable.
Figure 6:
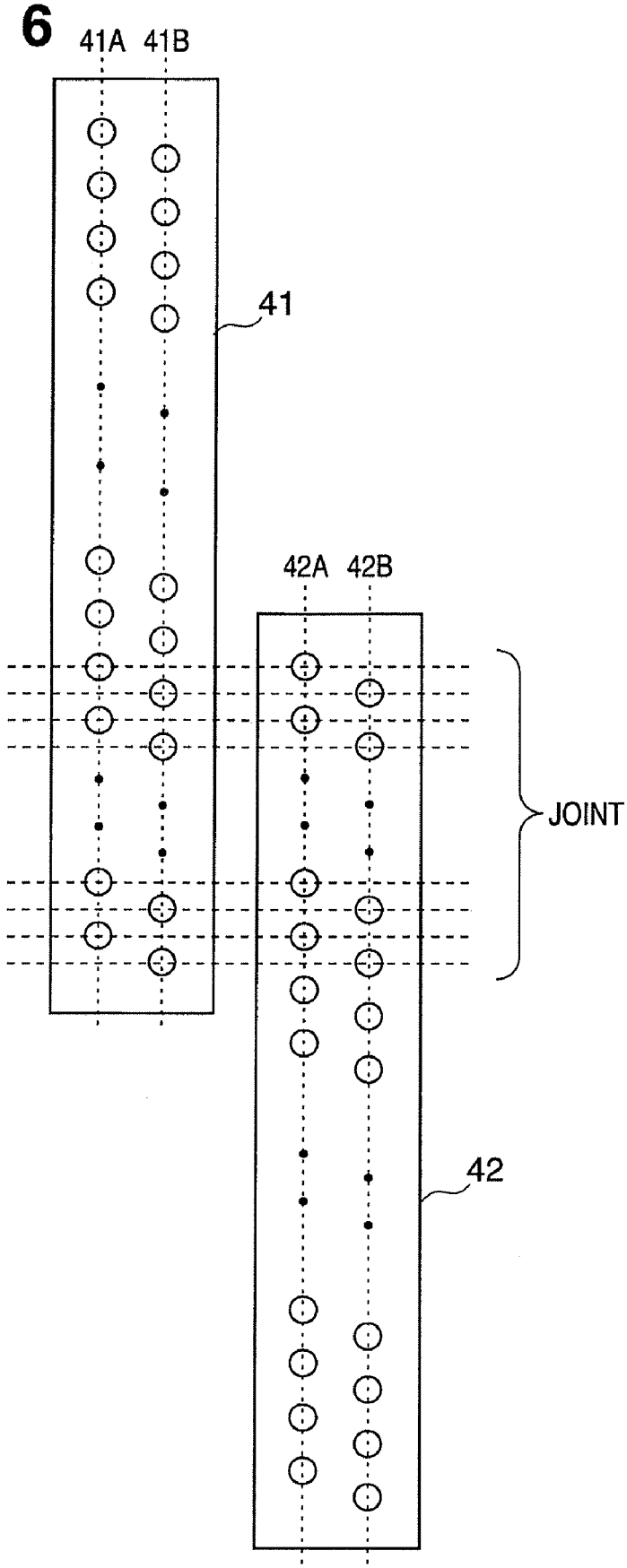
FIG. 6 is a schematic view illustrating in detail the positional relationship between printing element arrays 41A, 41B and 42A, 423 of printhead chips 41 and 42 in FIG. 5.

FIG. 5 is a schematic view illustrating a long-length printhead to which the present invention is applicable. Specifically, FIG. 5 shows a plurality of printhead chips arranged on the printhead, and printing element arrays of each of the printhead chips. FIG. 6 is a schematic view illustrating in detail the positional relationship between printing element arrays 41A, 41B and 42A, 42B of printhead chips 41 and 42 in FIG. 5. This embodiment will be described with regard to FIGS. 5 and 6.

The full-line, long-length ink-jet printhead IJH of this embodiment consists of a plurality of printhead chips each having printing element arrays that are comparatively short (i.e., that have a small number of printing elements). Specifically, the ink-jet printhead IJH consists of printhead chips 41, 42, 43, 44, 45 and 46 having printing element arrays 41A, 41B; 42A, 42B; 43A, 43B; 44A, 44B; 45A, 45B; and 46A, 46B, respectively. This single long-length printhead is formed by arraying the printhead chips 41, 42, 43, 44, 45 and 46 along the array direction of the printing element arrays in partially overlapping fashion. Each printhead chip is constituted by two printing element arrays (left and right printing element arrays) offset from each other in the conveyance direction of the printing medium. A plurality of the discharge orifices 25 are arrayed at an identical pitch in each of the left and right printing element arrays. As illustrated in FIG. 6, the discharge orifices 25 of the right printing element array are staggered from those of the left printing element array by one-half pitch in the direction of the printing element arrays (that is, the arrays 41A and 41B are in staggered relation, and so are the arrays 42A and 42B, 43A and 43B, 44A and 44B, 45A and 45B, and 46A and 46B).

As for the mutual relationship between the discharge orifices situated at the ends of the printing element arrays when the printhead chips 41, 42, 43, 44, 45 and 46 are arrayed, the printhead chips are arranged in such a manner that there will be a combination of discharge orifices in such a positional relationship that at least two discharge orifices will line up in the conveyance direction of the printing medium. In other words, it is so arranged that at least two discharge orifices will overlap in the conveyance direction of the printing medium. (The area where overlap occurs is a so-called "joint".)

FIG. 7 is an explanatory view showing each printing element array in FIG. 5 and the printing ratios of these printing element arrays in the conveyance direction of a printing medium. The term "printing ratio" in the conveyance direction of the printing medium is a ratio corresponding to the distribution ratio of the print data. It is defined as the ratio of the number of print events borne by each printing element array to the total number of print events by the plurality of printing element arrays included in each printing section. Further, the "printing sections" are defined as follows, by way of example: A non-joint section in which printing is performed by ink from the discharge orifices solely of printing element arrays 41A and 41B is adopted as a section 41, and a joint section in which printing is performed by ink from the discharge orifices of printing element arrays 41A, 41B and 42A, 42B is adopted as a section 41-42. In each of sections 41, 42, 43, 44, 45 and 46, which represent non-joint sections, printing is performed by two printing element arrays (for example, by printing element arrays 41A and 41B in section 41). Here the printing ratio in the conveyance direction of the printing medium is 50% for each printing element array. Further, in each of sections 41-42, 42-43, 43-44, 44-45 and 45-46, which represent joint sections, there are four printing element arrays (e.g., printing element arrays 41A, 41B, 42A, 42B in section 41-42). However, the two printing element arrays (41A and 42B) that belong to both edges in the conveyance direction of the printing medium are not used (their printing ratio is 0%). The printing ratio of the two remaining printing element arrays (41B and 42A) is 50% for each.

Figure 8:
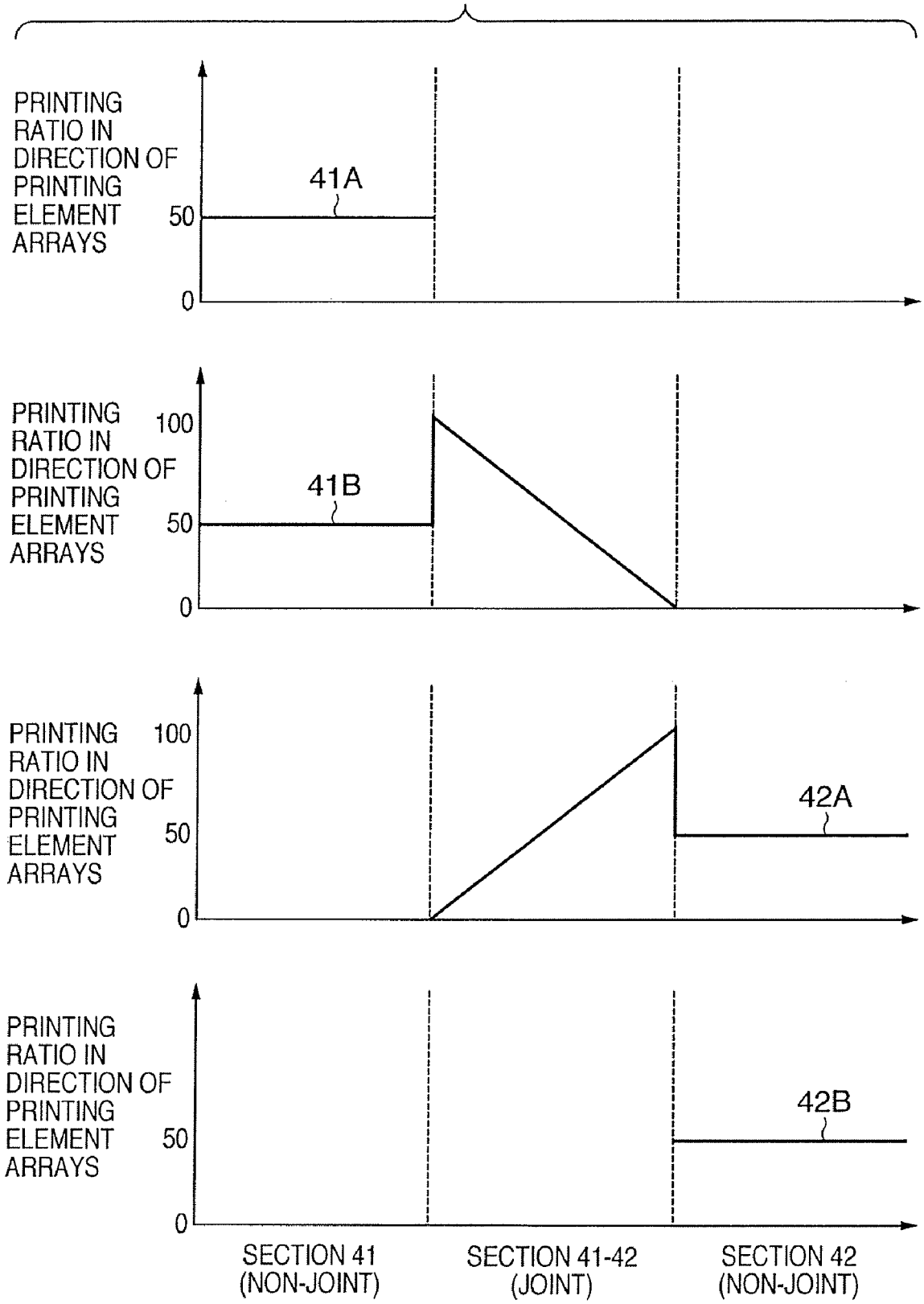
FIG. 8 is an explanatory view illustrating printing ratios in the direction of printing element arrays in the first embodiment.

FIG. 8 is an explanatory view illustrating printing ratios in the direction of the printing element arrays. Here only section 41 (a non-joint section), section 41-42 (a joint section) and section 42 (a non-joint section) are illustrated as typical examples, although the printing ratios are similar for the other sections as well. Here the printing ratio in the direction of the printing element arrays represents the printing ratio of each printing element array between overlapping chips. In section 41-42 (a joint section), printing by printing element arrays 41A and 42B is not carried out, but printing in this joint section is performed by printing element arrays 41B and 42A.

The printing of an image was performed using a printing apparatus having a basic configuration similar to that shown in FIG. 1. Printheads having the basic arrangement shown in FIG. 3 were disposed in a manner similar to that depicted in FIG. 2.

Each printhead was driven so as to discharge a 2.8-pl droplet from the discharge orifice 25. Ink for a PIXUS iP7100 ink-jet printing apparatus (manufactured by Canon) available on the market was used as ink containing a colorant. Glossy photographic paper for ink-jet printing (Pro-Photo Paper, PR-101, manufactured by Canon) was used as the printing medium.

More specifically, the ink-droplet discharge frequency was made 8 kHz as the driving speed of the printhead. Further, printing resolution was made 2400 dpi in the conveyance direction of the printing medium and 1200 dpi in the direction of the printing element arrays. Also prepared as images to be printed were images in which the amount of ink injected had 100% duty, 75% duty, 50% duty and 25% duty, as well as a photograph-like image.

The images having the different duties mentioned above were printed by a single conveyance of the printing medium under set conditions mentioned above. As a result, regardless of the image, almost no stripe-like unevenness (connecting lines) could be visually identified at portions printed by overlapping discharge orifices corresponding to the joints of the chips, and images having satisfactory image quality devoid of any decline in image quality could be printed. Similarly, as a result of printing the photograph-like image, almost no stripe-like unevenness (connecting lines) could be visually identified at portions printed by overlapping discharge orifices corresponding to the joints of the chips, and an image having satisfactory image quality devoid of any decline in image quality could be printed.

Further, by employing two printing element arrays on the same printhead chip, an increase in the size of the apparatus and a rise in cost could be suppressed.

REFERENTIAL EXAMPLE 1

In a manner similar to the first embodiment, an ink-jet printhead comprising six printhead chips 41, 42, 43, 44, 45, 46 was prepared as illustrated in FIG. 5 as a long-length printhead used in this referential example.

FIG. 9 is an explanatory view illustrating each printing element array in FIG. 5 and the printing ratios of these in the conveyance direction of the printing medium according to this referential example. In each of the sections 41, 42, 43, 44, 45 and 46, which represent non-joint sections, of this referential example, printing is performed by two printing element arrays (for example, by printing element arrays 41A and 41B in section 41). Here the printing ratio in the conveyance direction of the printing medium is 50% for each printing element array. Further, in each of the sections 41-42, 42-43, 43-44, 44-45 and 45-46, which represent joint sections, printing is performed by four printing element arrays (e.g., printing element arrays 41A, 41B, 42A, 42B in section 41-42). The printing ratio in the conveyance direction of the printing medium is 25% for each of these printing element arrays.

Figure 10:
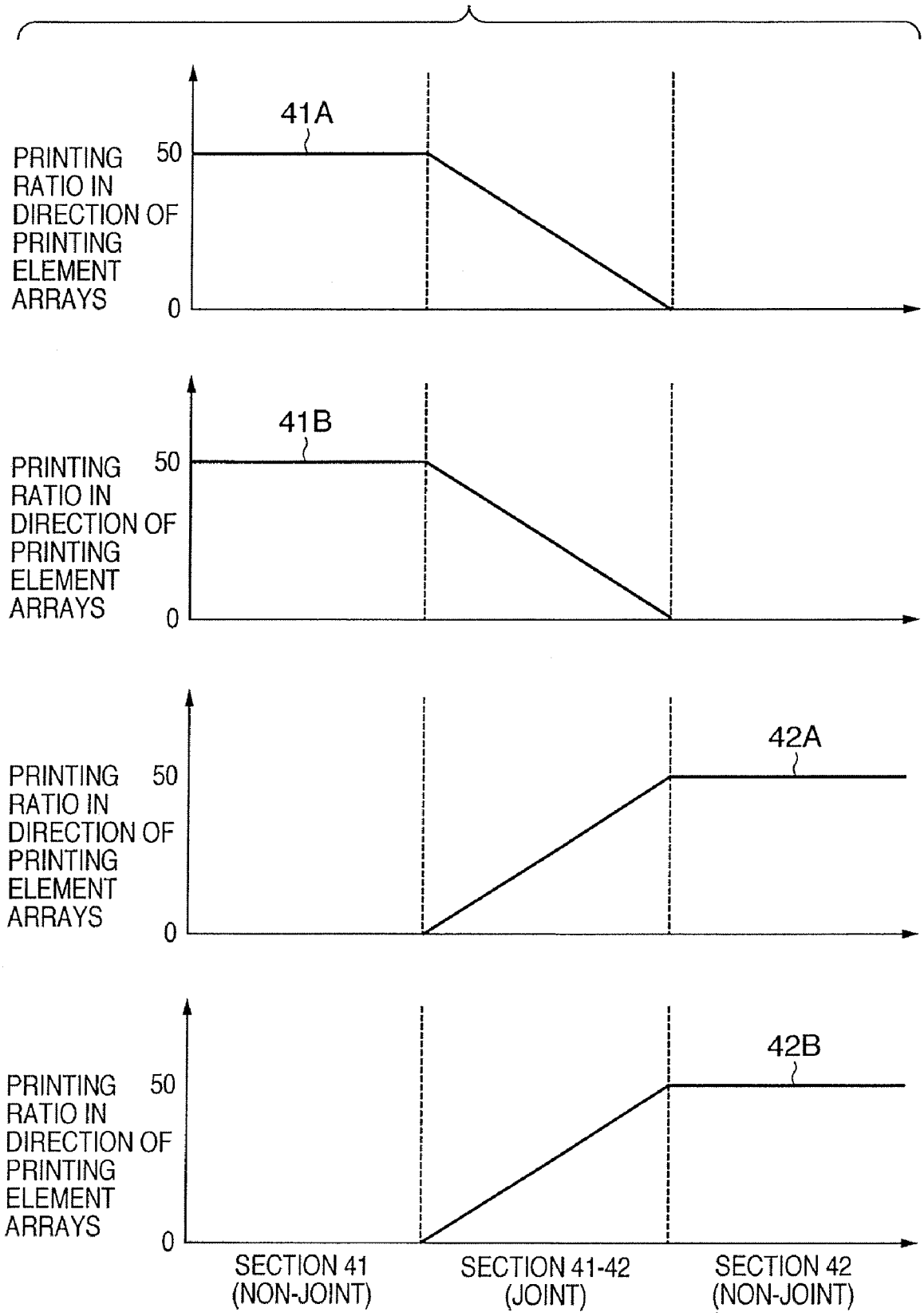
FIG. 10, which is illustrated as a first referential example for comparison with the first embodiment of the invention, shows printing ratios in the direction of printing element arrays.

FIG. 10 is an explanatory view illustrating printing ratios in the direction of the printing element arrays. Here only section 41 (a non-joint section), section 41-42 (a joint section) and section 42 (a non-joint section) are illustrated as typical examples, although the printing ratios are similar for the other sections as well. The printing ratio in the direction of the printing element arrays represents the printing ratio of each printing element array between overlapping chips.

The other conditions are the same as those of the first embodiment. As a result of printing the images having the different duties by a single conveyance of the printing medium under these conditions, connecting lines could be visually identified at portions printed by overlapping discharge orifices corresponding to the joints of the chips. Similarly, as a result of printing the photograph-like image, connecting lines could be visually identified at portions printed by overlapping discharge orifices corresponding to the joints of the chips. Thus, a satisfactory image quality could not be obtained.

COMPARATIVE EXAMPLE 1

Figure 11:
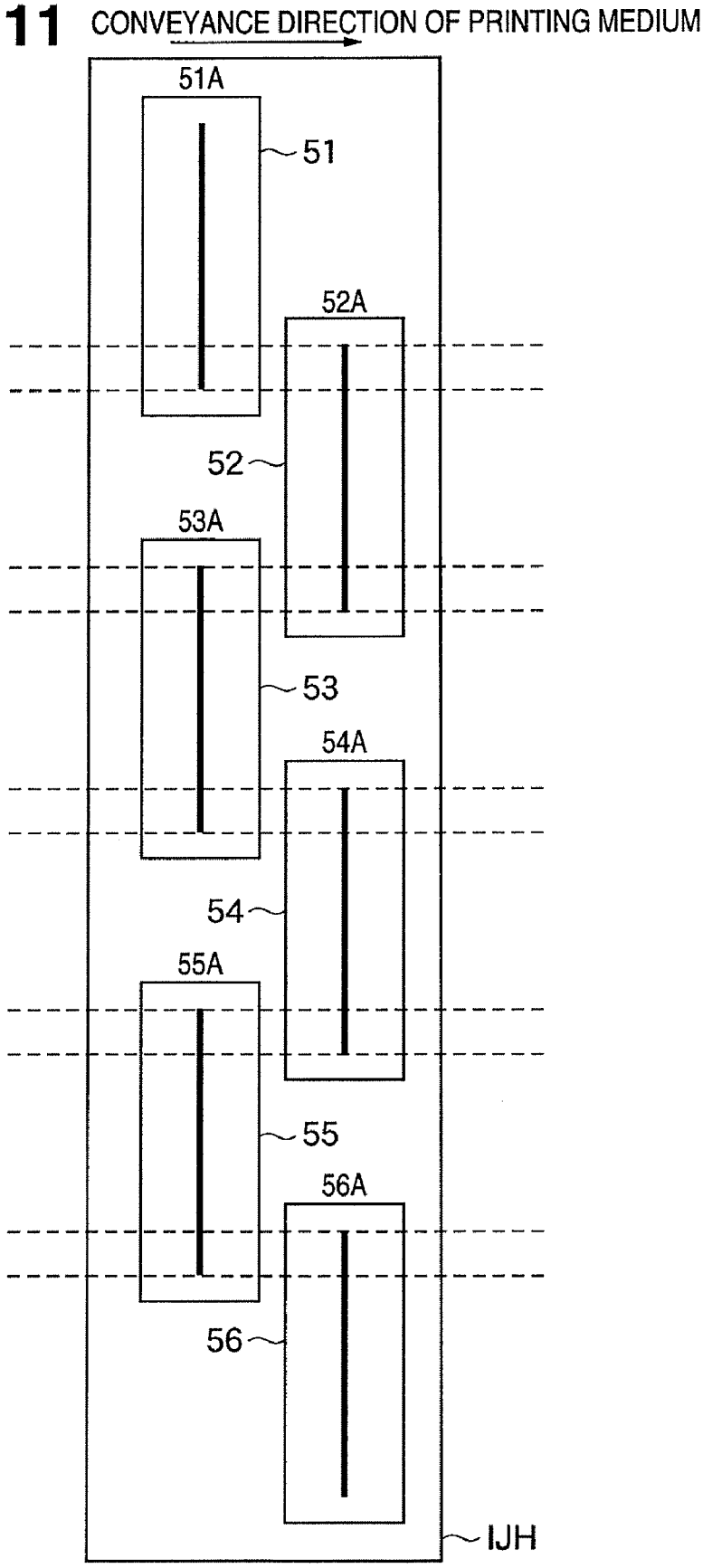
FIG. 11 is a schematic view illustrating the arrangement of a plurality of printing element arrays of a full-line-type long-length printhead of a first comparative example.
Figure 12:
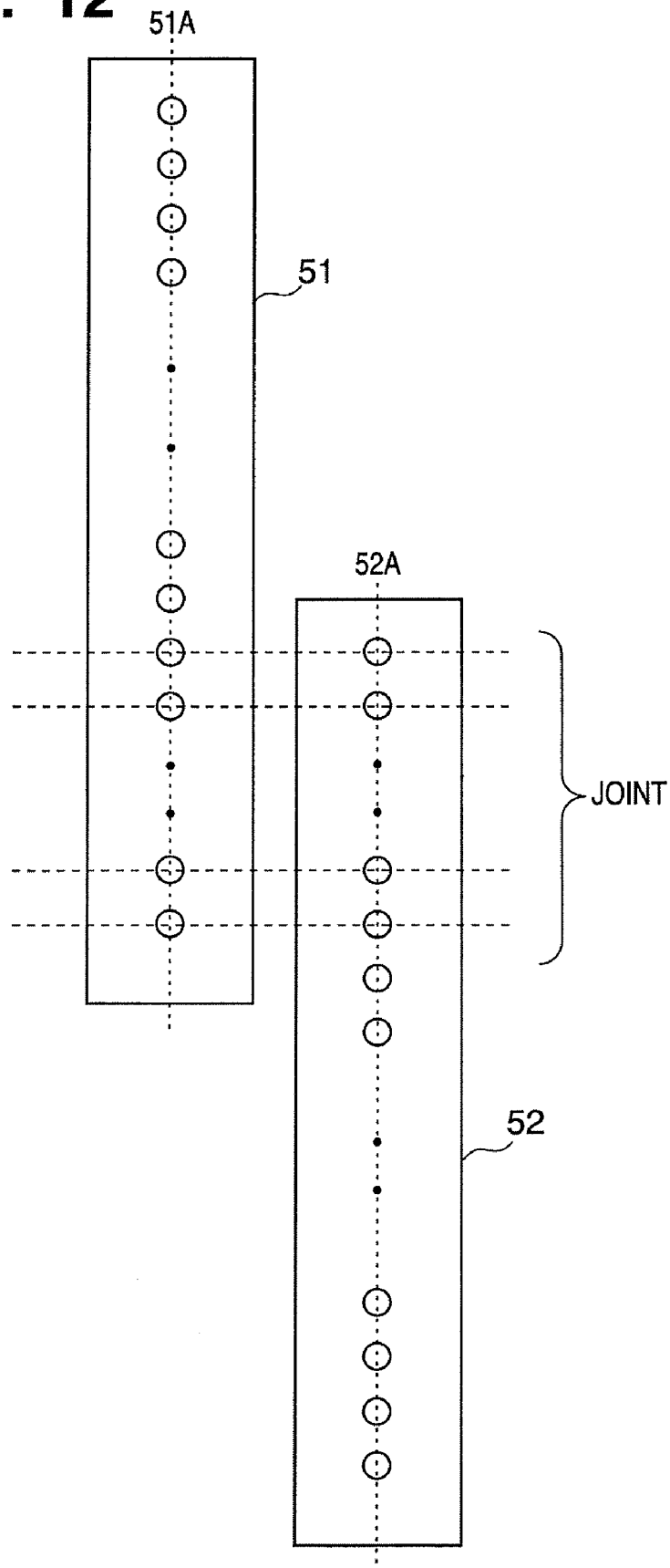
FIG. 12 is a schematic view illustrating in detail the positional relationship between printing element arrays 51A, 52A of printhead chips 51, 52, respectively, of FIG. 11.

FIG. 11 is a schematic view illustrating the arrangement of printhead chips and printing element arrays of a conventional full-line, long-length printhead in a first comparative example. FIG. 12 is a schematic view illustrating in detail the positional relationship between printing element arrays 51A, 52A of printhead chips 51, 52, respectively, of FIG. 11. This comparative example will be described with regard to FIGS. 11 and 12.

The full-line, long-length ink-jet printhead IJH of this comparative example consists of a plurality of printhead chips 51, 52, 53, 54, 55 and 56 having printing element arrays 51A, 52A, 53A, 54A, 55A and 56A, respectively, that are comparatively short (i.e., that have a small number of printing elements). This single long-length printhead is formed by arraying the printhead chips 51, 52, 53, 54, 55, 56 along the array direction of the printing element arrays in partially overlapping fashion. Each printhead chip is constituted by a single printing element array.

As for the mutual relationship between the discharge orifices situated at the ends of the printing element arrays when the printhead chips 51, 52, 53, 54, 55, 56 are arrayed, the printhead chips are arranged in such a manner that there will be a combination of discharge orifices in such a positional relationship that at least two discharge orifices will line up in the conveyance direction of the printing medium.

FIG. 13 is an explanatory view showing each printing element array in FIG. 11 and the printing ratios of these printing element arrays in the conveyance direction of a printing medium. In each of the sections 51, 52, 53, 54, 55 and 56, which represent non-joint sections, of this comparative example, printing is performed by one printing element array (for example, by printing element array 51A in section 51). Here the printing ratio in the conveyance direction of the printing medium is 100%. Further, in each of the sections 51-52, 52-53, 53-54, 54-55 and 55-56, which represent joint sections, printing is performed by two printing element arrays (e.g., printing element arrays 51A, 52A in section 51-52). The printing ratio in the conveyance direction of the printing medium is 50% for each of these printing element arrays.

Figure 14:
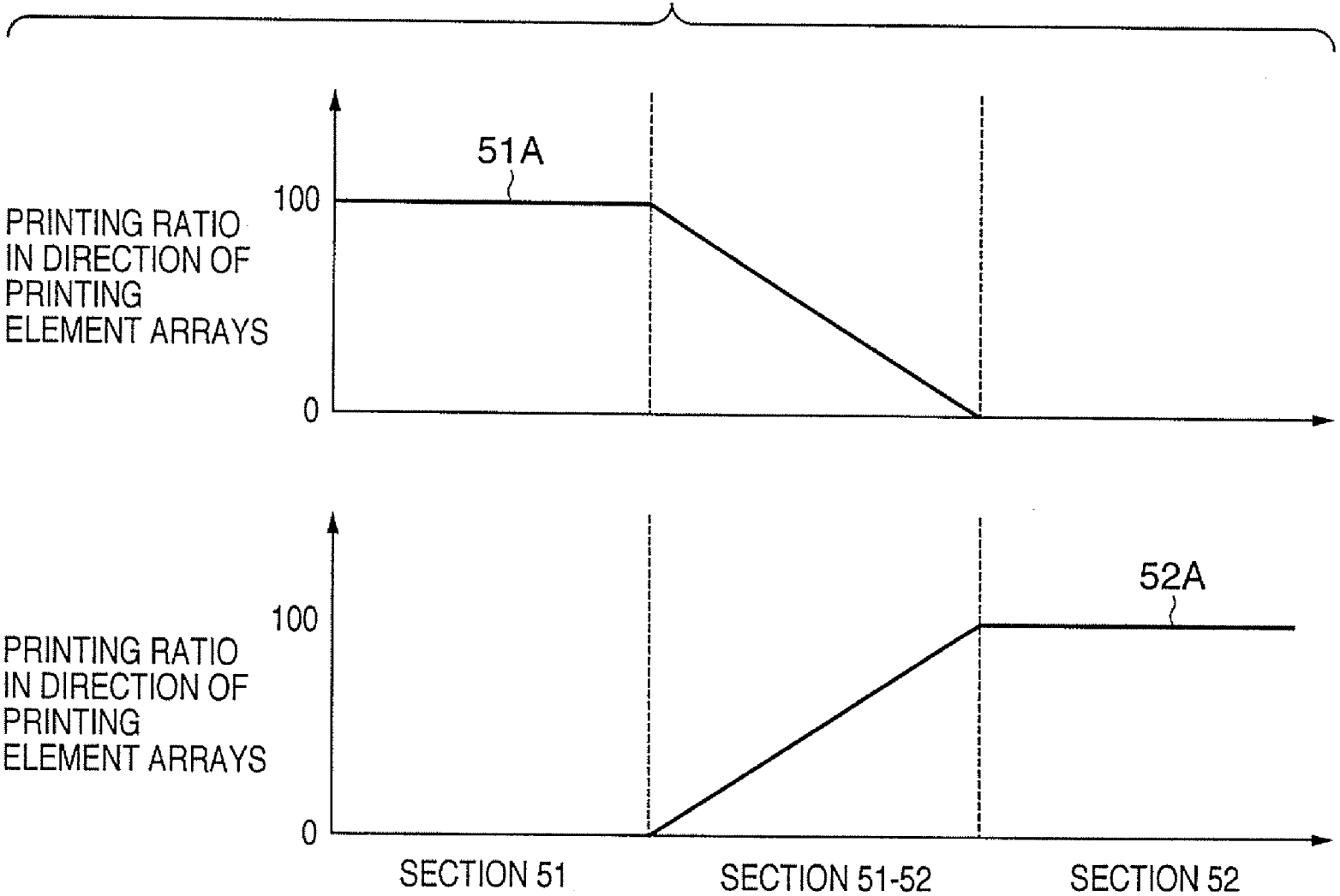
FIG. 14 is an explanatory view illustrating printing ratios in the direction of printing element arrays in the first comparative example.

FIG. 14 is an explanatory view illustrating printing ratios in the direction of the printing element arrays. Here only section 51 (a non-joint section), section 51-52 (a joint section) and section 52 (a non-joint section) are illustrated as typical examples, although the printing ratios are similar for the other sections as well. The printing ratio in the direction of the printing element arrays represents the printing ratio of each printing element array between overlapping chips.

The other conditions are the same as those of the first embodiment. As a result of printing the images having the different duties by a single conveyance of the printing medium under these conditions, connecting lines could be visually identified at portions printed by overlapping discharge orifices corresponding to the joints of the chips. Similarly, as a result of printing the photograph-like image, connecting lines could be visually identified at portions printed by overlapping discharge orifices corresponding to the joints of the chips. Thus, a satisfactory image quality could not be obtained.

Second Embodiment

A second embodiment will now be described. The second embodiment deals with a case where the printing element arrays on each printhead chip of the first embodiment are doubled in number from two to four. Since effects similar to those of multi-pass printing are obtained by increasing the number of printing element arrays, the image quality of the printed image is improved.

Figure 15:
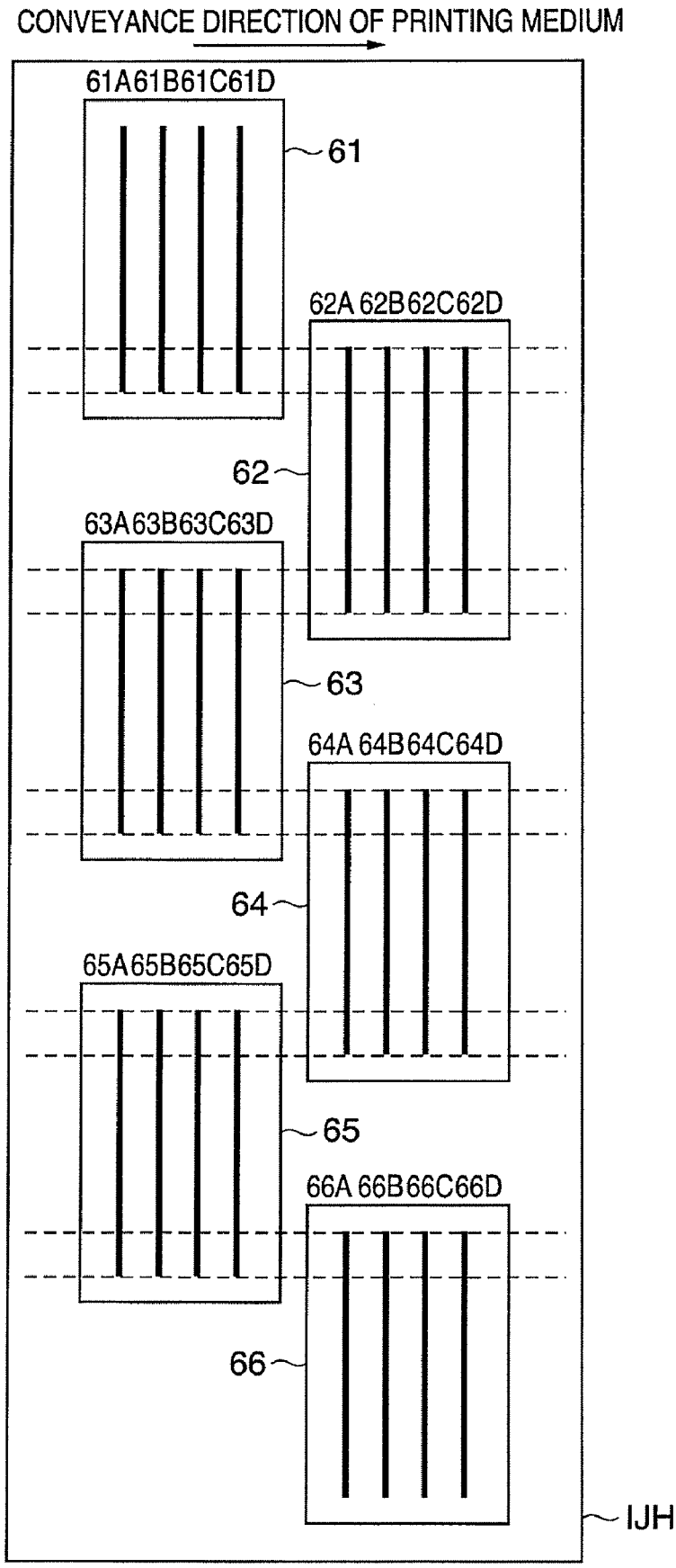
FIG. 15 is a schematic view illustrating the arrangement of a plurality of printing element arrays of a full-line-type long-length printhead as a second embodiment to which the present invention is applicable.
Figure 16:
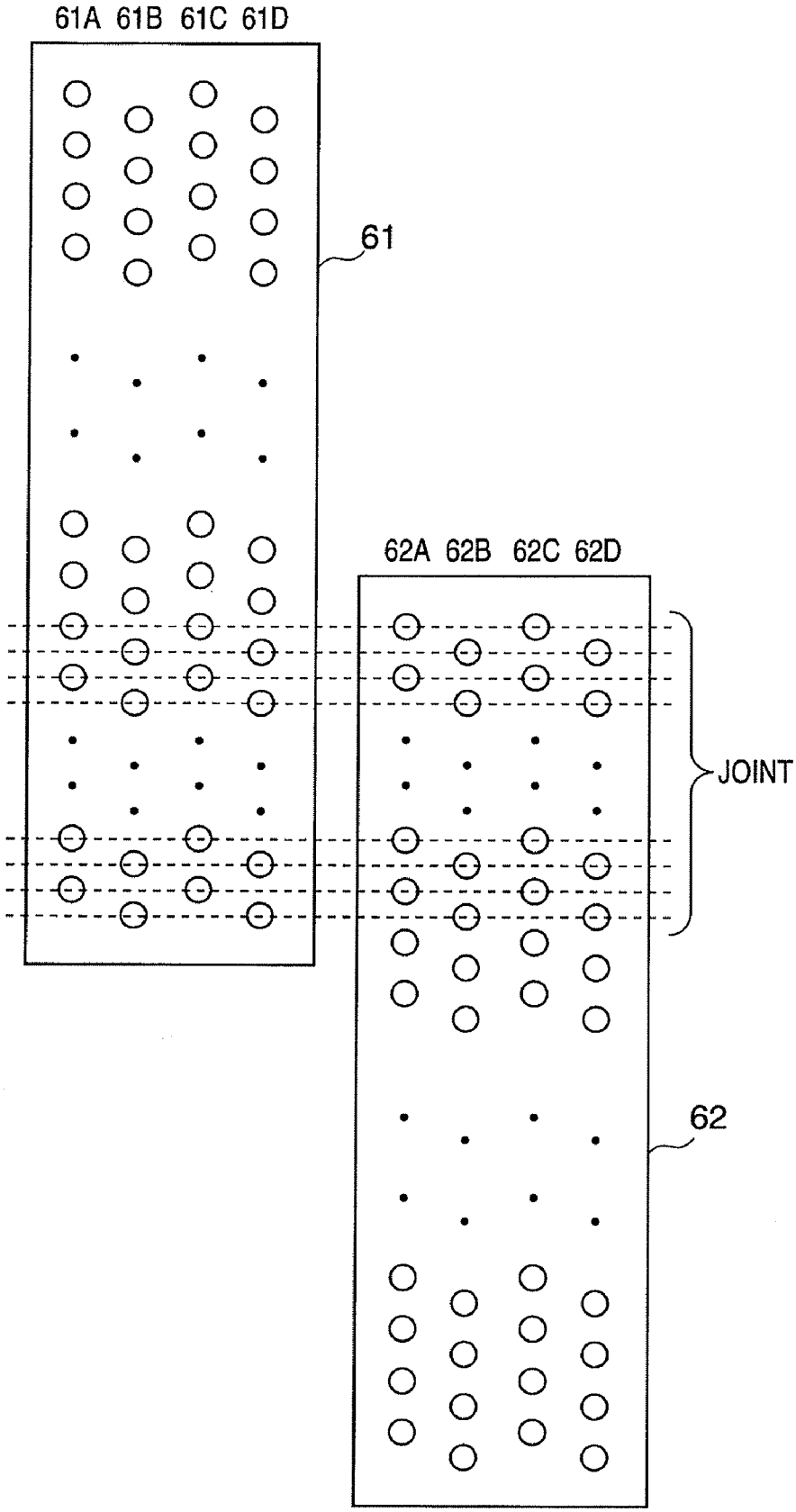
FIG. 16 is a schematic view illustrating in detail the positional relationship between printing element arrays 61A, 61B, 61C, 61D and 62A, 62B, 62C, 62D of printhead chips 61 and 62 in FIG. 15.

FIG. 15 is a schematic view illustrating the arrangement of printhead chips and printing element arrays of a full-line, long-length printhead to which the present invention is applicable. FIG. 16 is a schematic view illustrating in detail the positional relationship of printing element arrays 61A, 61B, 61C, 61D and 62A, 62B, 62C, 62D of printhead chips 61 and 62 in FIG. 15. This embodiment will be described with regard to FIGS. 15 and 16.

The full-line, long-length ink-jet printhead IJH of this example consists of a plurality of printhead chips 61, 62, 63, 64, 65 and 66 having printing element arrays 61A, 61B, 61C, 61D; 62A, 62B, 62C, 62D; 63A, 63B, 63C, 63D; and 64A, 64B, 64C, 64D; respectively, that are comparatively short (i.e., that have a small number of printing elements). This single long-length printhead is formed by arraying the printhead chips 61, 62, 63, 64, 65 and 66 along the array direction of the printing element arrays in partially overlapping fashion. Each printhead chip is constituted by four printing element arrays offset from each other in the conveyance direction of the printing medium. A plurality of the discharge orifices 25 are arrayed at an identical pitch in each of the four printing element arrays. Two rows of printing element arrays in which the discharge orifices of one row are staggered from those of the other row by one-half pitch in the direction of the printing element arrays are provided in two sets arrayed in the conveyance direction of the printing medium. In other words, two rows of printing element arrays are arranged in a dual structure.

As for the mutual relationship between the discharge orifices situated at the ends of the printing element arrays when the printhead chips 61, 62, 63, 64, 65 and 66 are arrayed, the printhead chips are arranged in such a manner that there will be a combination of discharge orifices in such a positional relationship that at least four discharge orifices will line up in the conveyance direction of the printing medium.

FIG. 17 is an explanatory view showing each printing element array in FIG. 15 and the printing ratios of these printing element arrays in the conveyance direction of the printing medium. In each of sections 61, 62, 63, 64, 65 and 66, which represent non-joint sections, printing is performed by four printing element arrays. The printing ratio in the conveyance direction of the printing medium is 25% for each of these printing element arrays. For example, printing is performed by the printing element arrays 61A, 61B, 61C and 61D in section 61. Further, in each of sections 61-62, 62-63, 63-64, 64-65 and 65-66, which represent joint sections, there are eight printing element arrays. For example, printing element arrays 61A, 61B, 61C, 61D, 62A, 62B, 62C, 62D are present in section 61-62. However, the four printing element arrays (61A, 61B, 62C, 62D) that belong to both edges in the conveyance direction of the printing medium are not used. The printing ratio of the four remaining printing element arrays (61C, 61D, 62A, 62B) is 25% for each.

Figure 18:
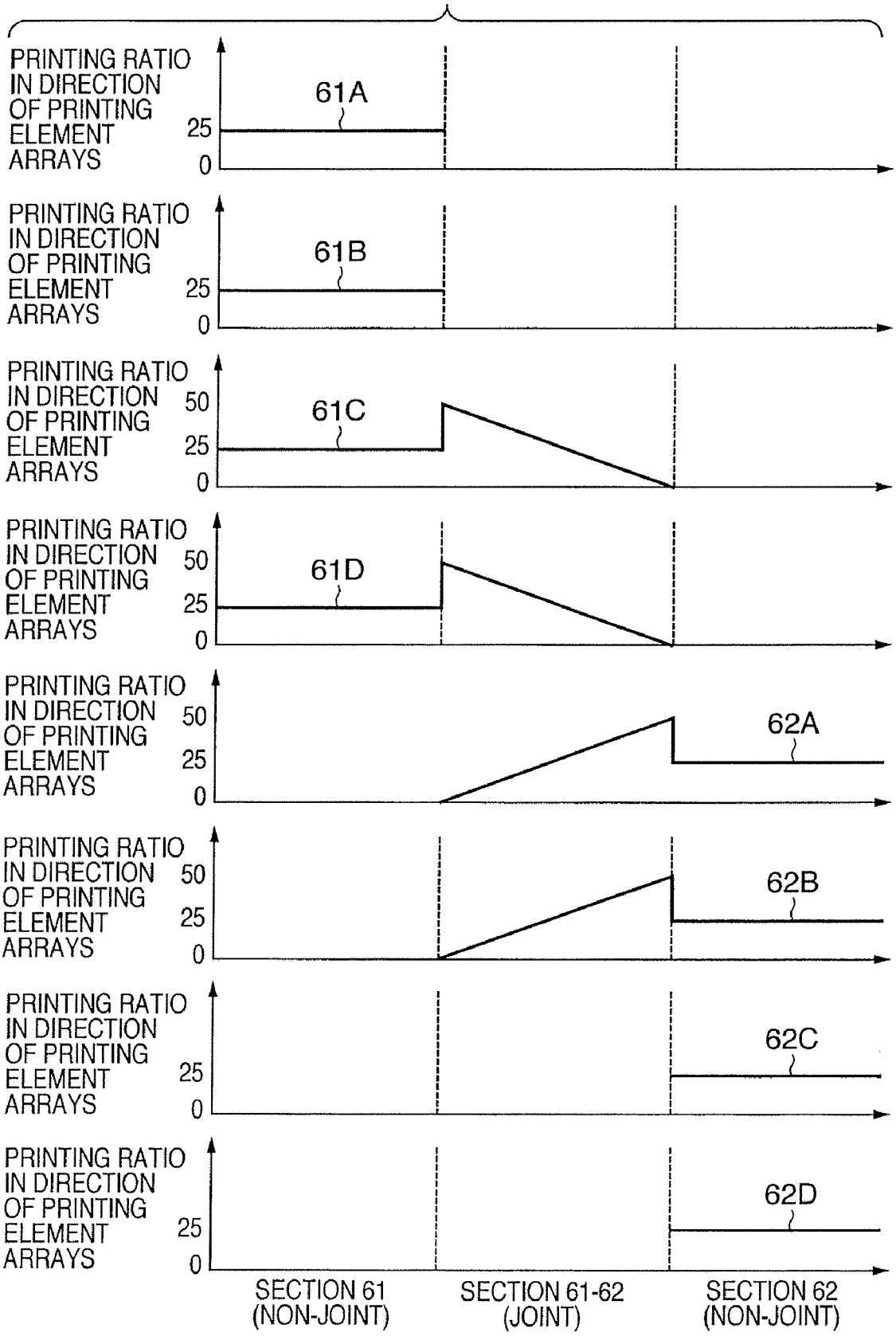
FIG. 18 is an explanatory view illustrating printing ratios in the direction of printing element arrays in the second embodiment.

FIG. 18 is an explanatory view illustrating printing ratios in the direction of the printing element arrays. Here only section 61 (a non-joint section), section 61-62 (a joint section) and section 62 (a non-joint section) are illustrated as typical examples, although the printing ratios are similar for the other sections as well. The printing ratio in the direction of the printing element arrays represents the printing ratio of each printing element array between overlapping chips. In section 61-62 (a joint section), printing by printing element arrays 61A, 61B, 62C and 62D is not carried out, but printing in this joint section is performed by printing element arrays 61C, 61D, 62C and 62D. It should be noted that this example is one example only and that the invention is not limited to this example.

The other conditions are the same as those of the first embodiment. As a result of printing the images having the different duties by a single conveyance of the printing medium under these conditions, connecting lines could not be visually identified at portions printed by overlapping discharge orifices corresponding to the joints of the chips, and a satisfactory image quality could be obtained. Similarly, as a result of printing the photograph-like image, connecting lines could not be visually identified at portions printed by overlapping discharge orifices corresponding to the joints of the chips, and a satisfactory image quality could be obtained.

In the example depicted in FIG. 15, four printing element arrays are provided on each printhead chip. By thus increasing the number of printing element arrays on the same printhead chip, an effect similar to multi-pass printing is produced. It was possible to obtain a printed image having an image quality even higher than that obtained with the arrangement of the first embodiment.

REFERENTIAL EXAMPLE 2

In a manner similar to the second embodiment, an ink-jet printhead comprising six printhead chips 61, 62, 63, 64, 65 and 66 was prepared as illustrated in FIG. 15 as a long-length printhead used in this referential example.

FIG. 19 is an explanatory view illustrating each printing element array in FIG. 15 and the printing ratios of these in the conveyance direction of the printing medium according to this referential example. In each of the sections 61, 62, 63, 64, 65 and 66, which represent non-joint sections, printing is performed by four printing element arrays and the printing ratio in the conveyance direction of the printing medium is 25% for each printing element array. For example, printing is performed by printing element arrays 61A, 61B, 61C and 61D in section 61. Further, in each of the sections 61-62, 62-63, 63-64, 64-65 and 65-66, which represent joint sections, printing is performed by eight printing element arrays and the printing ratio in the conveyance direction of the printing medium is 12.5% for each of these printing element arrays. For example, printing is performed by the printing element arrays 61A, 61B, 61C, 61D, 62A, 62B, 62C, 62D in section 61-62.

Figure 20:
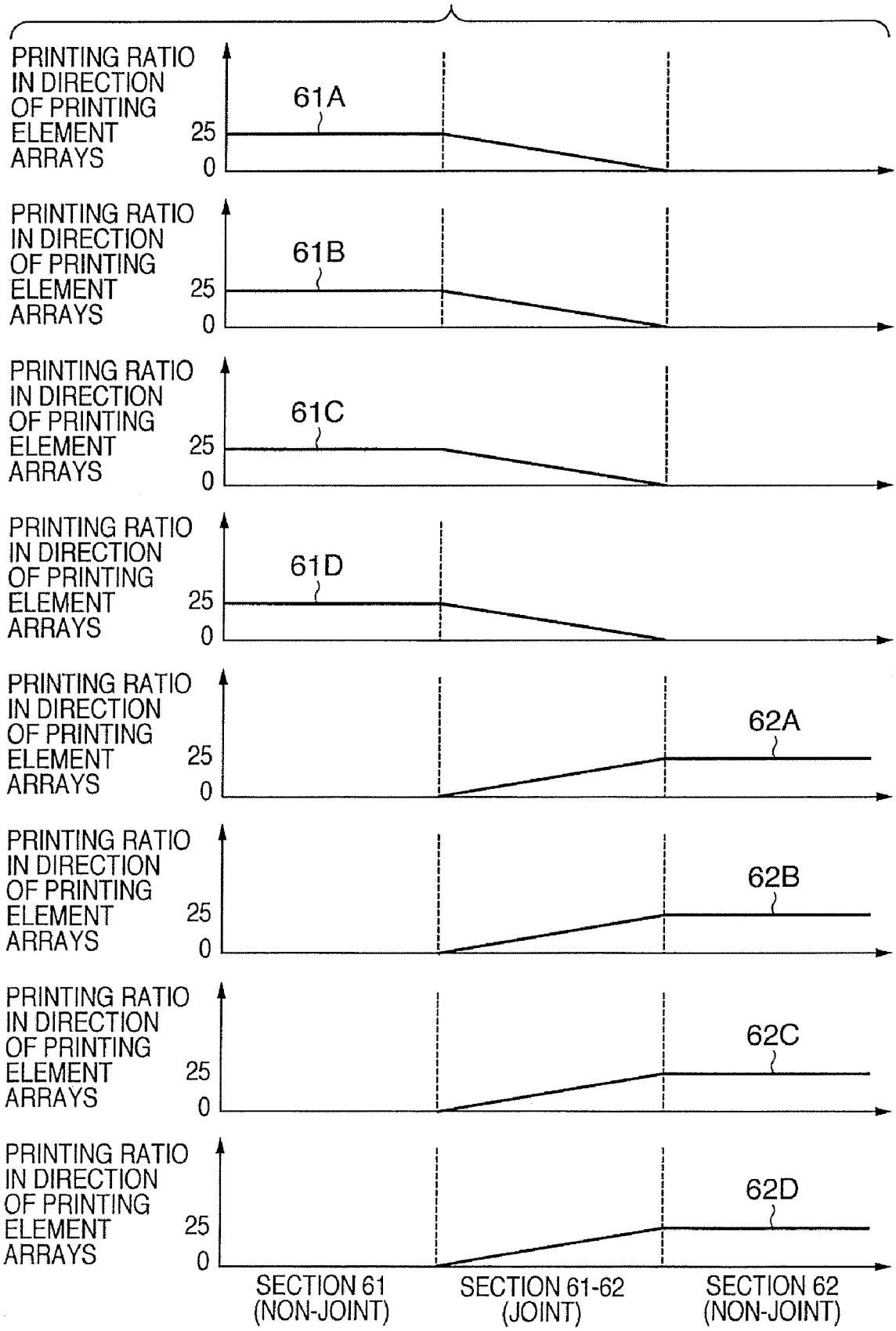
FIG. 20, which is illustrated as a second referential example for comparison with the second embodiment of the invention, shows printing ratios in the direction of printing element arrays.

FIG. 20 is an explanatory view illustrating printing ratios in the direction of the printing element arrays. Here only section 61 (a non-joint section), section 61-62 (a joint section) and section 62 (a non-joint section) are illustrated as typical examples, although the printing ratios are similar for the other sections as well. The printing ratio in the direction of the printing element arrays represents the printing ratio of each printing element array between overlapping chips.

The other conditions are the same as those of the first embodiment. As a result of printing the images having the different duties by a single conveyance of the printing medium under these conditions, connecting lines ascribable to variations in conveyance within the apparatus could be visually identified at portions printed by overlapping discharge orifices corresponding to the joints of the chips. Similarly, as a result of printing the photograph-like image, connecting lines ascribable to variations in conveyance within the apparatus could be visually identified at portions printed by overlapping discharge orifices corresponding to the joints of the chips, and a satisfactory image quality could not be obtained.

Other Embodiments

Figure 21:
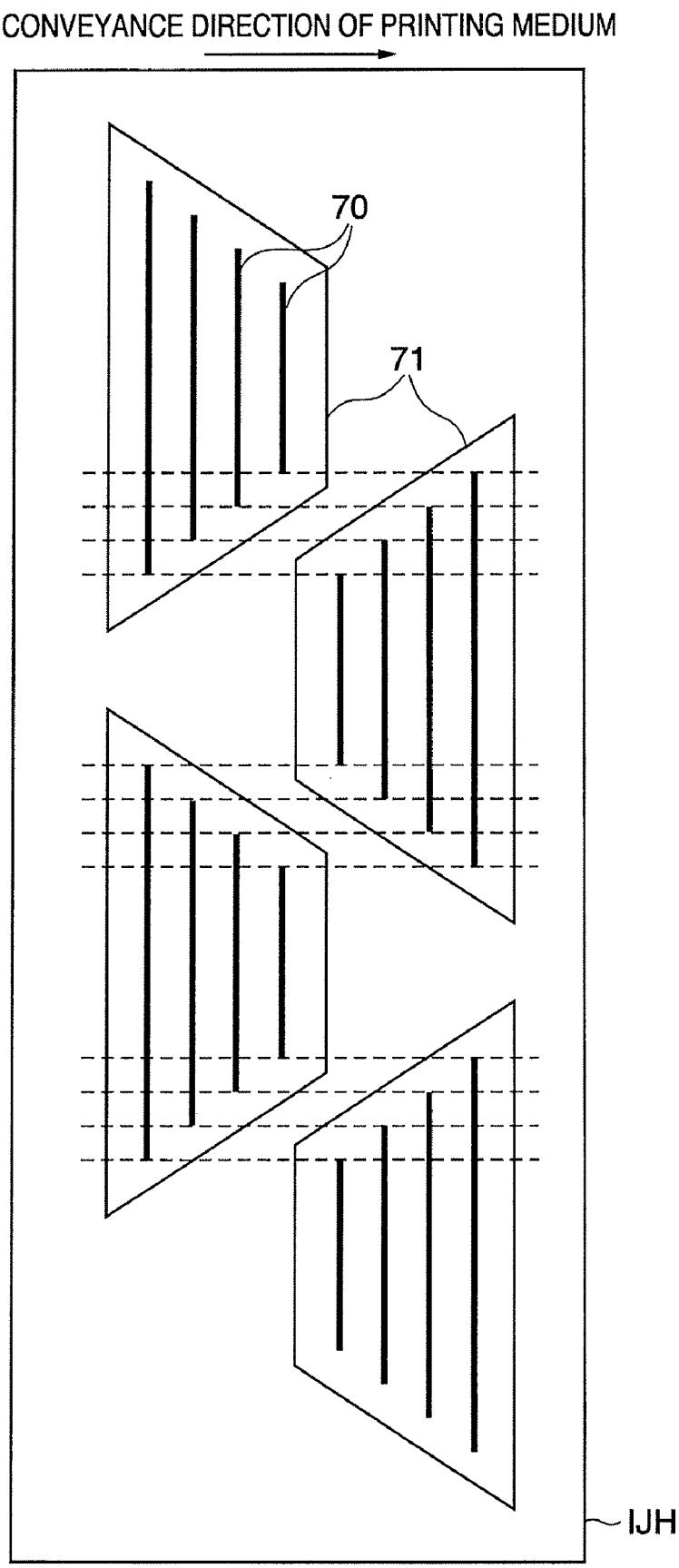
FIG. 21 is an explanatory view illustrating a head having a connected structure in which trapezoidal chips have been connected together.

The present invention is applicable to chip configurations other than those of the first and second embodiments. For example, the printhead may be one in which trapezoidal chips of the kind shown in FIG. 21 as one example are connected together, each chip having a plurality of printing element arrays. In FIG. 21, a printhead IJH is provided with printhead chips 71 each having printing element arrays 70. It will suffice if the printing ratio in the conveyance direction of the printing medium is set appropriately in such a manner that connecting lines cannot be visually identified. The number of discharge orifices that overlap at the joint portions of the chips can be set at will.

Various printheads having printing elements can be used as printheads and not only an ink-jet printhead having ink-jet printing elements capable of discharging ink from discharge orifices.

Further, the arrangement of the printhead chips and the printing scheme that can be applied to the present invention are not limited solely to those of the above-described embodiments.

Further, the present invention provides especially outstanding effects in a printing apparatus in which the ink-jet printing scheme is one that employs an ink-jet-type printhead that performs printing by forming flying droplets through use of thermal energy.

Furthermore, printheads that are effective include a printhead that is fixed to the main body of the apparatus, a printhead that is electrically connected to the main body of the apparatus by being attached to the apparatus, or a freely exchangeable printhead capable of being supplied with ink from the main body of the apparatus. Alternatively, the present invention is effective also in a case where use is made of a cartridge-type printhead in which an ink tank is provided as an integral part of the printhead itself.

Additionally providing printhead discharge recovery means and supplementary auxiliary means as constituents of the printing apparatus of the present invention makes it possible obtain the effects of the invention in more stable fashion and therefore is preferred. Specific examples of these means that can be mentioned include printhead capping means, cleaning means and pressurizing or suction means. Further examples are preliminary heating means for performing heating using electrothermal transducers or heating means separate from these or a combination of these, and preliminary discharge means for performing an ink discharge that is separate from the ink discharge used in printing.

Further, the present invention may be applied to a system constituted by a plurality of devices (e.g., a host computer, interface, reader, printer, etc.) or to an apparatus comprising a single device (e.g., a copier or facsimile machine, etc.).

Figure 22:
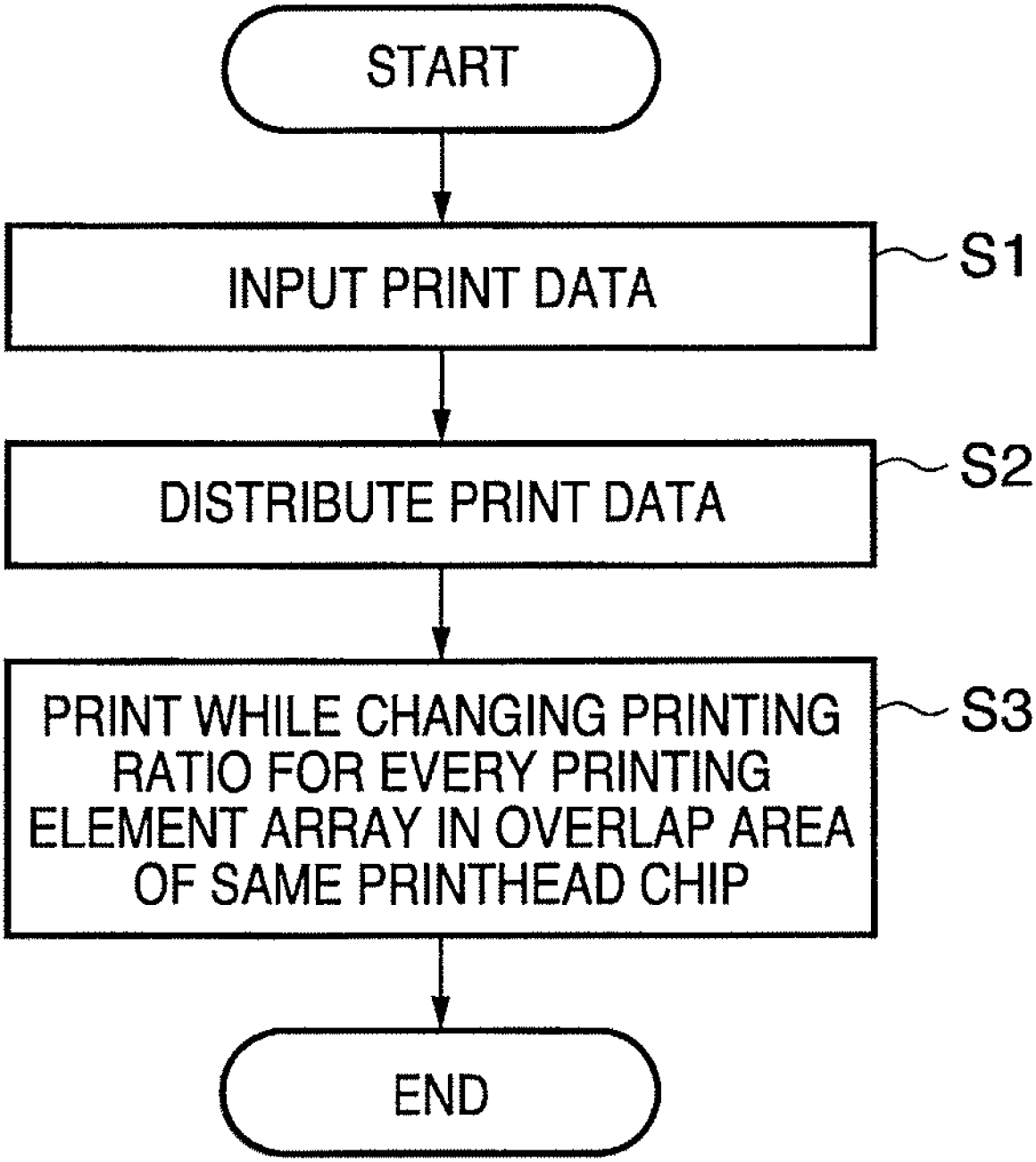
FIG. 22 is a flowchart illustrating a method of reducing connecting lines according to the present invention.

The printing method using the printing apparatus of the various types described above is summarized in the flowchart illustrated in FIG. 22.

First, print data is input at step S1. Next, at step S2, the print data is divided for every printing element array in order to distribute the print data. Then, at step S3, printing is performed while changing the printing ratio for every printing element array in the overlap area where the ends of the printing element arrays in the same printhead chip overlap each other. This makes it possible to achieve printing that is devoid of connecting lines in the areas where the printing element arrays overlap.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-225748, filed Aug. 22, 2006, which is hereby incorporated by reference herein in its entirety.

What is claimed is:

1. A printing apparatus having a printhead including a plurality of printhead chips, a plurality of printing elements being arranged in element arrays on each of the plurality of printhead chips, the plurality of printhead chips being arrayed in a staggered manner in a longitudinal direction of the printhead so that at least one of the printing elements in each element array of adjacent printhead chips in a direction perpendicular to the longitudinal direction overlaps, the printing apparatus using the printhead to print an image on a printing medium by conveying the printing medium in a direction perpendicular to the longitudinal direction, the apparatus comprising:

an input unit configured to input print data;

a distributing unit configured to distribute the print data to be used in printing to the printing elements of each of the element arrays; and a control unit configured to control a distribution ratio of print data to the at least one of the printing elements in each element array of the adjacent printhead chips in the direction perpendicular to the longitudinal direction, wherein, of the element arrays of each of the adjacent printhead chips, the control unit controls the distribution ratio of the element array that is closer to the adjacent printhead chip in the direction perpendicular to the longitudinal direction of the printhead to become greater.

2. The apparatus according to claim 1, wherein each printhead chip has two element arrays.

3. The apparatus according to claim 1, wherein each printhead chip has three or more element arrays.

4. The apparatus according to claim 1, wherein the distribution ratio of the print data to one of the printing elements in each element array of the adjacent printhead chips in the direction perpendicular to the longitudinal direction varies along the longitudinal direction of the printhead, the distribution ratio becoming smallest at an end portion of each of the element arrays.

5. The apparatus according to claim 1, wherein said printing apparatus is an ink-jet printing apparatus.

6. A printing method using a printing apparatus having a printhead including a plurality of printhead chips, a plurality of printing elements being arranged in element arrays on each of the plurality of printhead chips, the plurality of printhead chips being arrayed in a staggered manner in a longitudinal direction of the printhead so that at least one of printing elements in each element array of adjacent printhead chips in a direction perpendicular to the longitudinal direction overlaps, the printing apparatus using the printhead to print an image on a printing medium by conveying the printing medium in a direction perpendicular to the longitudinal direction, said method comprising:

an input step of inputting print data;

a distributing step of distributing the print data to be used in printing to the printing elements of each of the printing element arrays; and a control step of controlling a distribution ratio of print data to the at least one of the printing elements in each element array of the adjacent printhead chips in the direction perpendicular to the longitudinal direction, wherein, of the element arrays of each of the adjacent printhead chips, the control step controls the distribution ratio of the element array that is closer to the adjacent printhead chip in the direction perpendicular to the longitudinal direction of the printhead to become greater.

* * * * *